US005827464A

United States Patent [19]

Bennie et al.

[11] Patent Number: 5,827,464

[45] **Date of Patent: *Oct. 27, 1998**

[54] MAKING HIGH FILAMENT COUNT FINE FILAMENT POLYESTER YARNS

[75] Inventors: David George Bennie, Rocky Point; Robert James Collins, Wilmington; Hans Rudolf Edward Frankfort, Kinston; Stephen Buckner Johnson, Wilmington, all of N.C.; Benjamin Hughes Knox, Wilmington, Del.; Joe Forrest London, Jr., Greenville, N.C.; Elmer Edwin Most, Jr., Durhan, N.C.; Girish Anant Pai, Matthews, N.C.

[73] Assignee: E. I. du Pont de Nemours and Company, Wilmington, Del.

[ * ] Notice: The term of this patent shall not extend beyond the expiration date of Pat. No. 5,417,902.

[21] Appl. No.: 475,122

[22] Filed: Jun. 7, 1995

Related U.S. Application Data

[63] Continuation-in-part of Ser. No. 221,306, Mar. 31, 1994, abandoned, which is a continuation-in-part of Ser. No. 93,156, Jul. 23, 1993, Pat. No. 5,417,902, which is a continuation-in-part of Ser. No. 214,096, Mar. 17, 1994, abandoned, which is a continuation-in-part of Ser. No. 214,717, Mar. 16, 1994, Pat. No. 5,487,859, said Ser. No. 93,156, is a continuation-in-part of Ser. No. 926,538, Aug. 5, 1992, abandoned, Ser. No. 925,041, Aug. 5, 1992, abandoned, and Ser. No. 925,042, Aug. 5, 1992, abandoned, said Ser. No. 214,096, is a continuation-in-part of Ser. No. 926,538, Ser. No. 925,041, and Ser. No. 925,042, said Ser. No. 214,717, is a continuation-in-part of Ser. No. 926,538, Ser. No. 925,041, Ser. No. 925,042, Ser. No. 5,672, Jan. 19, 1993, Pat. No. 5,288,553, and Ser. No. 15,733, Feb. 10, 1993, Pat. No. 5,250,245, which is a continuation-in-part of Ser. No. 860,776, Mar. 27, 1992, abandoned, Ser. No. 647,381, Jan. 29, 1991, abandoned, and Ser. No. 647,371, Jan. 29, 1991, abandoned, said Ser. No. 5,672, is a continuation-in-part of Ser. No. 860,776, Ser. No. 647,381, and Ser. No. 647,371.

[51] Int. Cl.[6] ..... B29C 47/88

[52] U.S. Cl. ..... 264/211.12; 264/103; 264/168; 264/210.8; 264/211.14; 57/287; 57/289; 57/310; 57/350; 57/908

[58] Field of Search ..... 264/103, 168, 264/176.6, 169, 291, 177.13, 210.8, 211.14, 211.12, 288.4, 294; 57/287, 288, 289, 310, 350, 908

[56] References Cited

U.S. PATENT DOCUMENTS

| | | | |
|---|---|---|---|
| 2,604,667 | 7/1952 | Hebeler . | |
| 2,604,689 | 7/1952 | Hebeler . | |
| 3,432,590 | 3/1969 | Papps et al. | 264/210 |
| 3,433,007 | 3/1969 | Myers | 57/140 |
| 3,529,413 | 9/1970 | Marrinau et al. | 57/140 |
| 3,771,307 | 11/1973 | Petrille | 57/157 |
| 3,772,872 | 11/1973 | Piazza et al. | 57/140 R |
| 3,978,185 | 8/1976 | Buntin et al. | 264/93 |
| 4,025,994 | 5/1977 | Phillips | 28/72.12 |
| 4,026,099 | 5/1977 | Philips | 57/160 |
| 4,134,882 | 1/1979 | Frankfort et al. . | |
| 4,153,660 | 5/1979 | Reese | 264/103 |
| 4,156,071 | 5/1979 | Knox . | |
| 4,195,051 | 3/1980 | Frankfort et al. | 264/176 F |
| 4,233,363 | 11/1980 | Cemel et al. . | |
| 4,251,481 | 2/1981 | Hamlyn | 264/210.3 |
| 4,341,063 | 7/1982 | Southerlin et al. | 57/6 |
| 4,349,501 | 9/1982 | Hamlyn | 264/210.3 |
| 4,390,685 | 6/1983 | Oka et al. | 528/272 |
| 4,478,036 | 10/1984 | Pittman | 57/283 |
| 4,622,187 | 11/1986 | Palmer | 364/103 |
| 4,929,698 | 5/1990 | Hagewood . | |
| 4,933,427 | 6/1990 | Charles et al. . | |
| 5,223,198 | 6/1993 | Frankfort . | |
| 5,250,245 | 10/1993 | Collins et al. . | |
| 5,417,902 | 5/1995 | Bennie et al. . | |

*Primary Examiner*—Merrick Dixon

[57] ABSTRACT

A direct melt spinning process for providing high filament count fine filament polyester yarns having excellent mechanical quality and along-end uniformity and unitary interlace by spinning all the filaments of such high filament count yarn from a single spinneret. Such yarns may be used as direct-use yarns and as draw-feed yarns for preparing drawn flat yarns and draw-textured yarns.

11 Claims, 3 Drawing Sheets

MAKING HIGH FILAMENT COUNT FINE FILAMENT POLYESTER YARNS

CROSS-REFERENCE TO RELATED APPLICATIONS

This application is a continuation-in-part of our application Ser. No. 08/221,306 (DP-4555-L), filed Mar. 31, 1994, which is being abandoned, and is itself a continuation-in-part of both of our applications Ser. Nos. 08/093,156 (DP-4555-J), filed Jul. 23, 1993, now U.S. Pat. No. 5,417,902, and 08/214,096 (DP-4555-I), filed Mar. 16, 1994, also being abandoned, and also of 08/214,717 (DP-4555-H), filed Mar. 16, 1994, by Aneja et al, now U.S. Pat. No. 5,487,859, all themselves being continuations-in-part, respectively, of applications Ser. Nos. 07/926,538 (DP-4555-E), 07/925,041 (DP-4555-D) and 07/925,042 (DP-4555-C), all three filed Aug. 5, 1992 and now abandoned, and of applications Ser. Nos. 08/005,672 (DP-4555-F), filed by Collins et al, Jan. 19, 1993, now U.S. Pat. No. 5,288,553, and 08/015,733 (DP-4555-G) filed by Collins et al., Feb. 10, 1993, now U.S. Pat. No. 5,250,245, themselves variously continuations-in-part of three applications Ser. Nos. 07/860,776 (DP-4555-B) filed Mar. 27, 1992, and 07/647,381 (DP-4555-A) and 07/647,371 (DP-4555 and sometimes referred to as the "parent" application), both filed Jan. 29, 1991, all three now abandoned.

TECHNICAL FIELD

The invention concerns improvements in and relating to melt-spinning fine continuous filament polyester yarns and particularly to an improved process for preparing such yarns of high filament count (HFC) having improved uniformity such as makes these yarns especially suitable for textile end-uses that may require downstream processing without breaking filaments and for use in dye-critical textile applications.

BACKGROUND

Polyester filament yarns of denier per filament (dpf) less than about 1 (i.e., similar to the dpf of silk), are commercially available, but are more costly to make than filament yarns of more conventional dpf (similar to that of cotton). Our so-called "parent" application Ser. No. 07/647,371 (now abandoned in favor of a continuation-in-part application now issued as U.S. Pat. No. 5,250,245, as was a companion case, now issued as U.S. Pat. No. 5,288,553, the disclosure of both of which are hereby incorporated herein by reference) was concerned with the preparation of such fine filaments by a novel direct melt-spinning process.

Reaction in the trade to the fine filament textile (flat or textured) yarns has tended to limit their use in textile fabrics unless the total yarn denier ($D_Y$) of the fine filament yarn is approximately the same as that of the higher dpf yarn that it replaces. For example, if an incumbent yarn has filaments of denier 1.5 dpf (and we shall refer to this incumbent yarn as a low filament count (LFC) yarn) is to be replaced by a finer filament yarn whose filaments are of half the dpf of the LFC yarn, i.e., 0.75 dpf, then the number of filaments in the finer filament (0.75 dpf) yarn needs to be approximately twice that of the incumbent LFC yarn to be a direct replacement in existing textile end-uses, i.e., to provide the same fabric weight (grams/meters$^2$). In other words, an LFC yarn of, for instance, 100 filaments and 150 denier (i.e., 1.5 dpf), should be replaced by an HFC yarn, also of 150 denier, but of 200 filaments, on account of the lower 0.75 dpf. Some fiber producers have, therefore, spun two (or more) separate smaller fine filament "bundles" and have then co-mingled (interlaced) the separate smaller bundles to provide a single HFC yarn of the desired total yarn denier ($D_Y$) equal to that of the larger dpf LFC yarn that is to be replaced. They have done this despite the loss in spinning productivity this separate spinning has entailed; the loss in spinning productivity results from the fact that two (or more) spinnerets are used to provide filaments for only one yarn. The reason for using more spinnerets has been a belief, based on previous experience with spinning filaments of higher dpf, that, to maintain satisfactory quality levels (along-end denier, structure uniformity and mechanical quality are the criteria used by us), it has not been desirable to increase the number (#) of filaments spun per "useful" extrusion area in the face of the spinneret (referred to herein as filament extrusion density (FED), given as #/cm$^2$) significantly over what was previously used to spin the larger dpf LFC yarn. If a customer were to receive from a fiber producer separate smaller fine filament yarns of low yarn denier, the customer would want to co-mingle two or more of these smaller fine filament yarns to obtain the desired total yarn denier ($D_Y$), which would be an added cost to him in making the final textile yarn. Also co-mingling filament yarns that have been spun separately has not provided the same visual fabric aesthetics (or dye uniformity) as provided by interlacing a single HFC bundle of the same yarn denier ($D_Y$). In other words, there has been a significant detectable difference in aesthetics and/or performance between a plied yarn and a unitary interlaced yarn.

Accordingly, it has been desirable to provide a melt-spinning process for spinning a single HFC bundle of fine dpf filaments from a single extrusion spinneret (i.e., without the need for plying two or more filament bundles) and thereby not sacrificing spinning productivity, while maintaining required along-end uniformity and mechanical quality for down-stream processing of the HFC fine filament yarn.

SUMMARY OF THE INVENTION

According to the invention, there is provided a process of preparing by melt-spinning an interlaced multifilament (HFC) yarn of at least 150 fine filaments in number (#) and of 0.5 to 2.2 spun denier per filament $(dpf)_S$, from a polyester polymer of 13 to 23 relative viscosity (LRV) and of 240° C. to 265° C. zero-shear melting point ($T_m^o$) comprising :

(i) melting the polyester polymer, heating the resulting melt to a polymer temperature (Tp) that is 25° C. to 55° C. above the $T_m^o$, and filtering the heated melt;

(ii) extruding the filtered melt through at least 150 capillaries in the face of a spinneret to form the aforesaid number (#) of at least 150 filamentary streams at a filamentary extrusion density (FED) of at least 6 filaments/cm$^2$ and at a total melt mass flow rate W, in g/min, the total melt mass flow rate of all these streams being W (=w×#) where w is the mass flow rate through a single capillary and $=(dpf)_S\times(V_S)/9000$, where $V_S$ is the spinning withdrawal speed and is at least 2 Km/min;

(iii) protecting the freshly-extruded filamentary streams immediately below the face of the spinneret by a delay shroud (of length $L_q$ cm below said face), then cooling them by quenching air of laminar velocity ($Q_a$ m/min), such that the Spin Factor SF is 0.2 to 1, where said Spin Factor (SF) is calculated according to the expression:

$$SF=k\{(LRV)[(T_m^o+25)/(Tp)]^6[(V_S)^2/(dpf)_S][(Q_a/W)^{0.2}]$$

$[(FED)(L_q)]^{-0.7}\}^n$ where "k"=$2.4\times10^{+5}$ and 'n'=minus (−) 0.8;

(iv) cooling the filamentary streams to a temperature below $T_g$, converging the resulting cooled filaments into a single multifilament bundle of at least 150 filaments at a convergence distance ($L_c$, in cm) from the face of the spinneret, and interlacing the single multifilament bundle to provide an interlaced spin-oriented yarn;

and wherein the interlaced yarn is wound to form a package at a winding speed of 2 to 5 Km/min.

As indicated, the Spin Factor (SF) is important; it is defined by the expression:

$$SF=k[\eta_a\sigma_F Q_F]^n,$$

and in the "expanded" form by the expression used herein:

$$SF=k\{(LRV)[(T_m{}^o+25)/(Tp)]^6[(V_S)^2/(dpf)_S][(Q_a/W)^{0.2}][(FED)(L_q)]^{-0.7}]\}^n$$

where $k=2.4\times10^5$ n=minus (−) 0.8

ηa (apparent melt viscosity)=(LRV)$[(T_m{}^o+25)/(T_P)]^6$

σF(spinline stress factor)=$(V_S)^2/(dpf)_S$

QF (quench factor)=$[(Q_a/W)^{+0.2}][(FED)(L_q)^{-0.7}]$

W(g/min/extrusion bundle)=(# filaments)×(w)

w (g/min/capillary)=$[(dpf)_S\times V_S(m/min)/9000]$ $Q_a$=laminar air flow in meters per minute FED=# filaments per "useful" extrusion area in $cm^2$ $L_q$=delay quench length in cm;

and where all three $\eta_a$, $\sigma_F$, and $Q_F$ should be balanced as indicated in the above relationship to give a Spin Factor (SF) of 0.2 to 1 in order to spin uniform fine filament (HFC) yarns according to the invention.

Quality levels of the filaments are desirably measured by along-end denier (i.e., a low Denier Spread (DS), desirably less than 2.5%, particularly less than about 2.0%, preferably less than about 1.5%, and especially about 1.0% or less, it being understood that these uniformity criteria are increasingly difficult to obtain as the dpf is reduced), structure uniformity (as measured by the along-end draw tension (coefficient of) variation (DTV, %) which should desirably be less than 1%, and is discussed more in detail in relation to Spin Factor (SF), especially referring to FIG. 1, hereinafter) and mechanical quality (as measured by normalized tenacity-at-break-denier $(T_B)_n$, where $(T_B)_n$= Tenacity (g/d)$(RDR)_S$ $(20.8/LRV)^{0.75}$, as discussed later, where $(RDR)_s$ is the residual spun draw ratio and is defined by $(RDR)_S=[1+(E_B)/100]$, where $(E_B)$ is the percentage elongation-to-break).

As will be discussed, capillary dimensions herein and in the art (D for diameter and L for length) can be extremely important. Such dimensions are preferably such that the L/D ratio is at least 2, and the $L/D^4$ value is at least 335 $mm^{-3}$.

By this new melt-spinning process, according to the present invention, it has been possible to achieve a melt-spinning productivity of at least 5000, where melt-spinning productivity ($P_S$) is given as the product of the withdrawal speed ($V_S$) in m/min and the residual spun draw ratio $(RDR)_S$ of the spin-oriented filaments according to the expression, ($P_S=V_S\times(RDR)_S$), and $(RDR)_S$ is given by $(RDR)_S=[1+(E_B)/100]$, where $(E_B)$ is the percentage elongation-to-break.

The resulting interlaced multi-filament yarns are believed new, as will be indicated, because they number at least 150 filaments of fine denier, up to 2.2 spun dpf $(dpf)_S$, and up to 1 dpf, when drawn, and yet their filament entanglement shows unitary interlace. They show desirable uniformity, as expressed for the filaments by low DTV values, and desirably by low DS, and for the yarns by high $(T_B)_n$ values, as indicated.

Some of the spin-oriented yarns may be used as such, i.e., in as-spun condition as "direct-use" yarns, and most of them may be drawn in a coupled or split process, single-end or in a form of a sheet of few ends, or in the form of a weffless warp sheet, to provide drawn flat multi-filament yarns having a residual elongation as desired, generally between about 15% to about 40%, and normalized $(T_B)_n$ values of at least 5 g/dd, preferably of at least 5.5 g/dd, and especially of at least 6 g/dd. Such drawing may be incorporated as part of a split or coupled draw-texturing process, such as draw air-jet texturing or draw false-twist texturing, in which case the yarns may be drawn to somewhat higher elongation, e.g. up to about 45%. The yarns may, if desired, be subjected to a compression crimping process (e.g., stuffer-box crimping).

The HFC yarns of the invention (whether spun or drawn, flat or textured yarns) have unitary interlace and have at least 150 filaments, preferably at least 175 filaments and especially at least 200 filaments. As indicated, the spun denier $(dpf)_S$ of the as-spun filaments is desirably 0.5 to 2.2, and preferably 0.6, 0.65 or 0.7 on up, e.g., to about 2 $(dpf)_S$. The denier per filament of the drawn (e.g., flat or draw-textured) HFC yarns of the invention desirably have a filament denier of about 1 or less and generally up to about 0.8, e.g. 0.2 to 0.8 dpf. Draw-textured HFC yarns of the invention are further characterized by an elongation-to-break of 15% to 45%, a normalized tenacity-at-break-denier of at least 4 g/dd, preferably at least 4.5 g/dd, and a Toray Fray Count of less than 10 per 1000 meters, preferably less than 5 per 1000 meters. Indeed, as may be seen in the Examples, Fray Counts of 0 have been achieved according to the invention.

High filament count (HFC) post-bulkable yarns may be prepared by spinning and gently heat-setting an HFC mixed-filament yarn comprised of two or more types of filaments that differ in denier and/or cross-section under conditions selected such as to provide a potential differential shrinkage (because of differential crystallinity) between the filament types, i.e. sufficient to preserve a shrinkage difference of at least 5% (i.e., not to over heat set), and such that when the drawn mixed-filament yarn is heated under relaxed conditions the differing filaments of the HFC drawn mixed-filament yarn still have sufficient differential shrinkage to shrink differentially and so give a yarn having different filament lengths (giving along-end loops) and thereby provide an HFC bulky yam comprised of core filaments (previously of high shrinkage) having a $(dpf)_{core}$ greater than the dpf of the surface filaments (previously of lower shrinkage). In HFC mixed-shrinkage yarns of the invention the surface filaments after boil-off shrinkage (ABO) desirably have a $(dpf)_{ABO}$ of less than 1, and preferably less than 0.8; and the total yarn average $(dpf)_Y$ (after boil-off) should generally be less than 1 (as shown, e.g., in Example 5).

Further aspects and embodiments of the invention will appear hereinafter.

Preferred filaments of the invention denoted by the "widely-spaced" //////area are especially suitable as draw-feed yarns, being defined by $E_B$-values of about 90% to 160% and ($1-S/S_m$) value of at least about 0.05 (line 7).

Preferred filaments of the invention especially suitable for direct-use, i.e. without further drawing and/or heating, are denoted by the "densely-spaced" area bordered by $E_B$-values of about 40% to about 90% and ($1-S/S_m$) ratio at least about 0.85 (line 1).

The expression ($1-S/S_m$) is used herein as a relative degree of stress-induced crystallization (SIC). $S_m$ is the expected maximum shrinkage potential for filaments of a given degree of molecular extension ($E_B$) in the absence of crystallinity, and may be calculated as follows:

$$S_m(\%)=([(E_B)_{max}-E_B)]/[(E_B)_{max}+100])100\%,$$

wherein $(E_B)_{max}$ is the expected maximum elongation-to-break ($E_B$) of totally amorphous "isotropic" filaments. For polyester filaments spun from polymer of typical textile viscosities LRV-values of about 13 to about 23), the nominal value of $(E_B)_{max}$ is experimentally found to be about 550% providing for a maximum residual draw-ratio of 6.5 (Reference: High-Speed Fiber Spinning, ed. A. Ziabicki and H. Kawai, Wiley-Interscience (1985), page 409) and thus, $S_m$ (%) is defined, herein, by the simplified expression:

$$[(550-E_B)/650]\times 100\%$$

Figure 1:
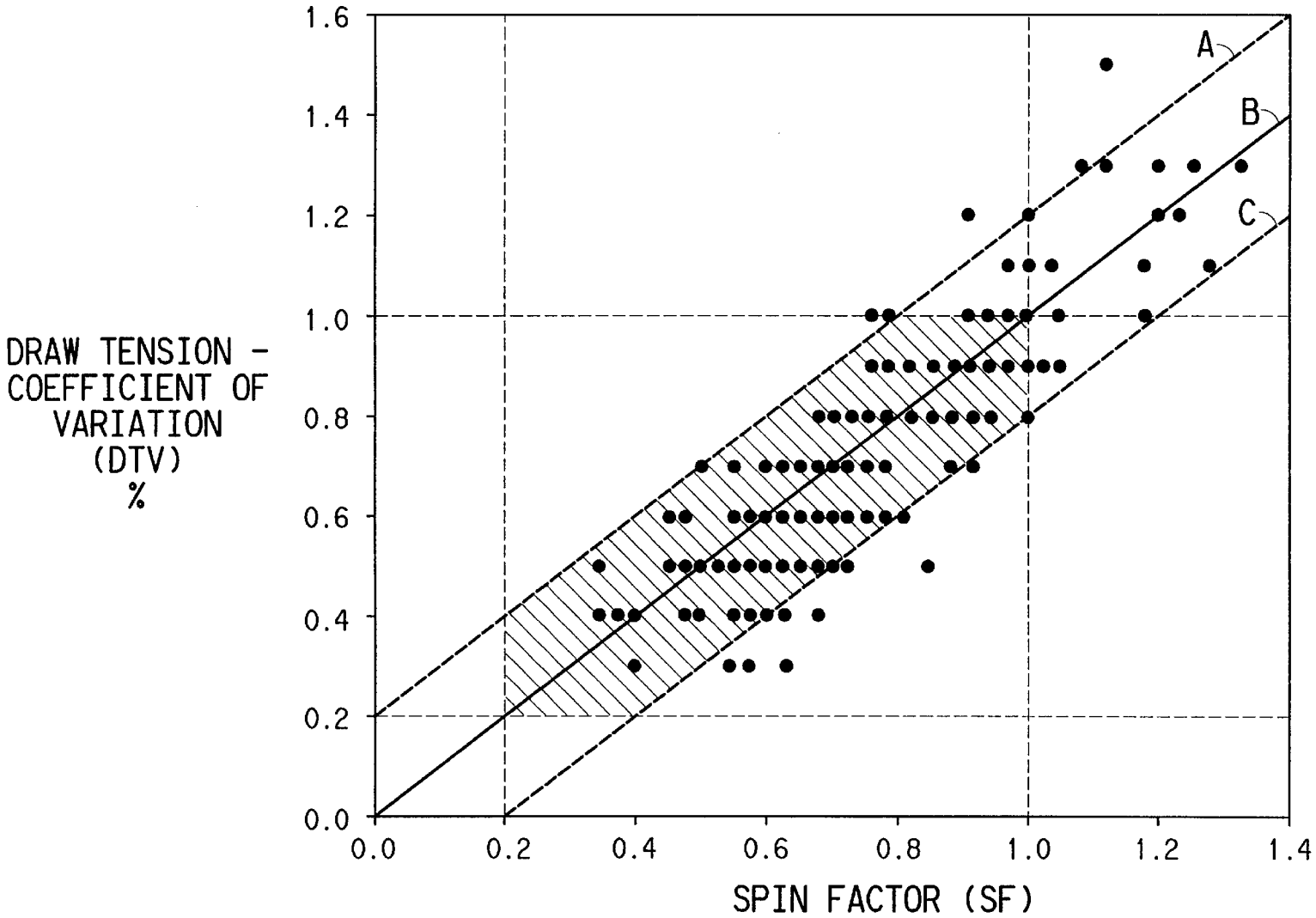
FIG. 1 is a plot of draw tension variation (DTV, %) versus the Spin Factor SF, defined hereinbefore. Undrawn yarns of the invention preferably have DTV-values of less than 1%, and are spun so the SF is in the range of 0.2 to 1 as shown by the lightly dashed lines. Preferred combinations of DTV and SF-values for making preferred yarns of the invention are represented by the shaded area/////// between Lines A and C, where Lines A and C have the formula DTV=a(SF)+b, wherein a=1 and b=+0.2 and −0.2 for Lines A and C, respectively (on either side of especially preferred Line B, expressed similarly, except that b=0 for line B), and where the DTV and SF values are both between 0.2 and 1.
Figure 2:
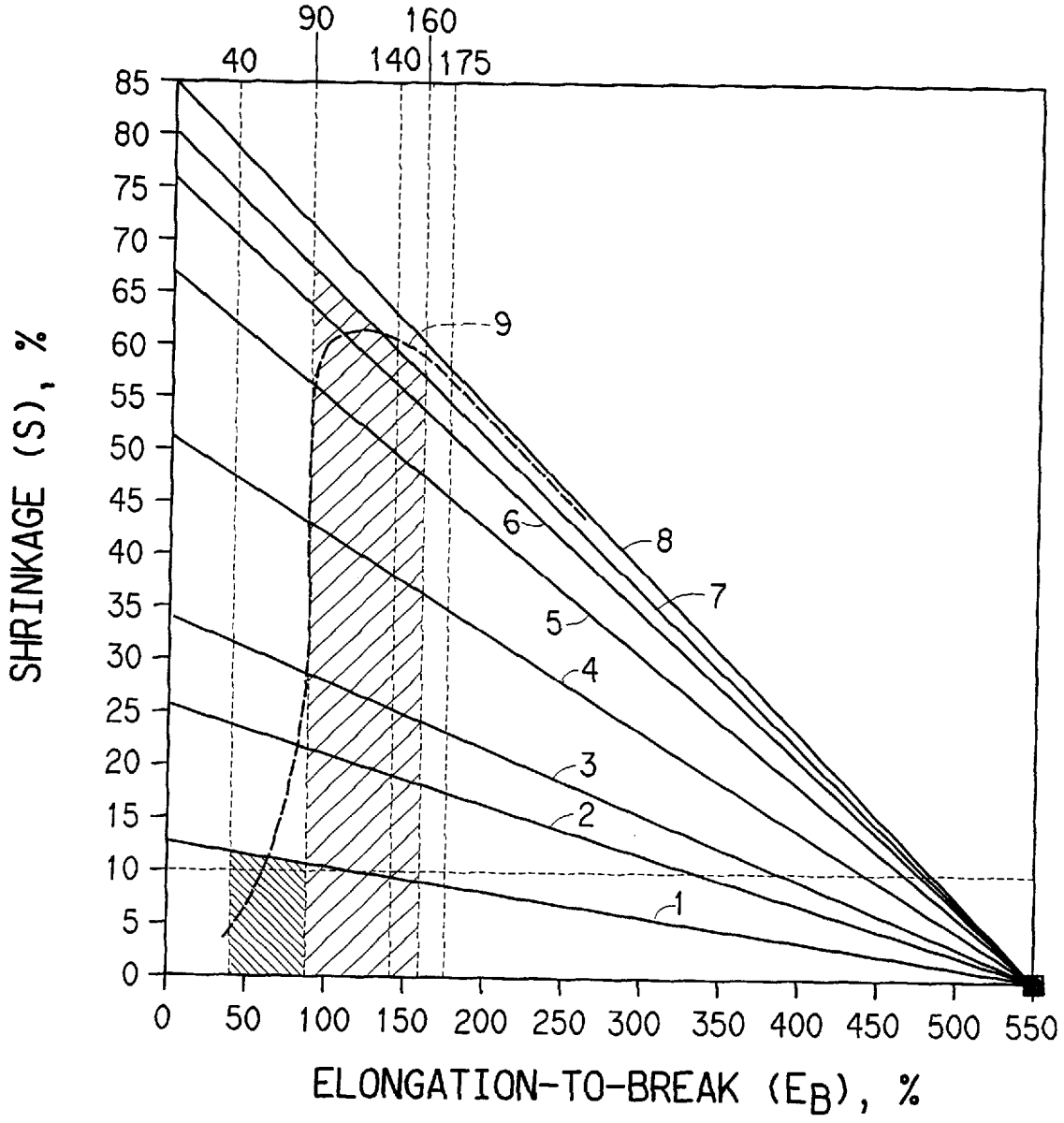
FIG. 2 is a representative plot of percent boil-off shrinkage (S) versus percent elongation-to-break ($E_B$) wherein straight Lines 1, 2, 3, 4, 5, 6, 7, and 8 represent ($1-S/S_m$)-values of 0.85, 0.7, 0.6, 0.4, 0.2, 0.1, 0.05, and 0, respectively, and curved Line 9 represents a typical shrinkage versus elongation-to-break relationship for a series of yarns formed, for example, by increasing spinning speed, but keeping all other process variables unchanged. Changing other process variables (such as dpf, polymer viscosity) produces a "family" of similar curved lines that are of essentially similar configurations. The vertical dashed lines denote ranges of $E_B$-values for preferred filaments of the invention, i.e., $E_B$ values of 40% to 175%, with 160% as a practical upper limit, based on age stability, and especially up to 140%.
Figure 3:
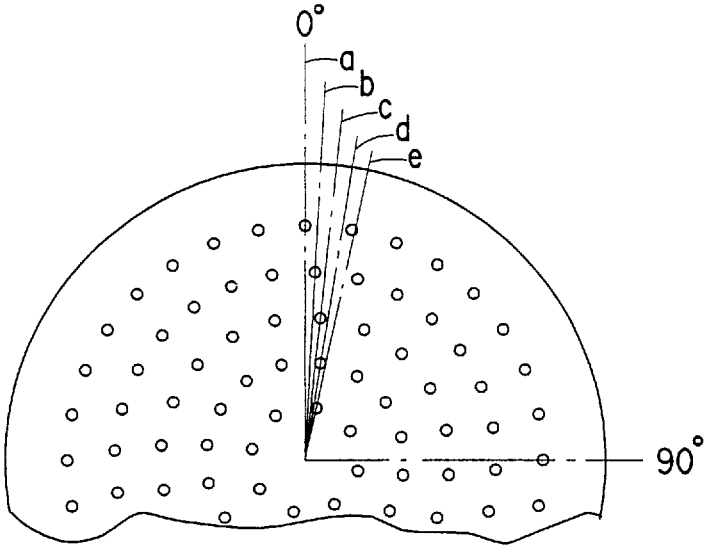
Figure 4:
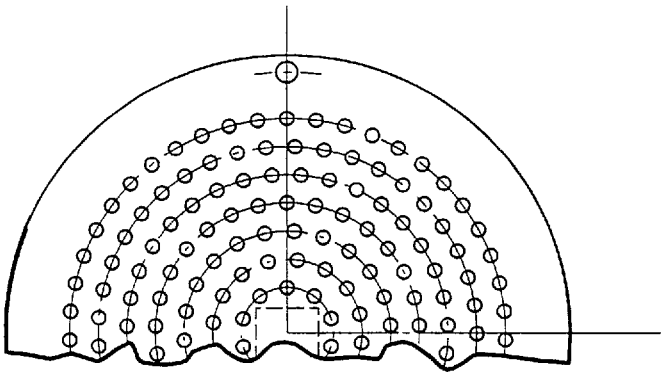

FIGS. 3 and 4 are partial schematic representations of partial spinneret arrangements having high filament extrusion density (FED). The arrays are designed to optimize flow of cooling air through the extrusion bundle, and to minimize coalescence of freshly-extruded filaments and poor spinning performance and poor along-end uniformity of the quenched filament bundle. Such arrangement is described in allowed application Ser. No. 08/214,717 (DP-4555H), filed by Aneja et al. on Mar. 16, 1994, from which the 5-ring arrangement of FIG. 3 was taken, merely for convenience. The orifices can be arranged in more rings to give an HFC yarn, while being staggered similarly, so as to increase the number of filaments spun from a single spinneret. This is shown in FIG. 4 for spinning 200 filaments from a single spinneret.

DETAILED DESCRIPTION OF THE INVENTION

The polyester polymer used for preparing spin-oriented filament yarns of the invention is the same as for the "parent" application; that is, the polyester polymer is an ethylene terephthalate polymer selected to have a relative viscosity (LRV) in the range about 13 to about 23, a zero-shear melting point ($T_m^o$) in the range about 240° C. to about 265° C.; and desirably a glass-transition temperature ($T_g$) in the range about 40° C. to about 80° C. (wherein $T_m^o$ and $T_g$ are measured from the second DSC heating cycle under nitrogen gas at a heating rate of 20° C. per minute). The said polyester polymer is a linear condensation polymer composed of alternating A and B structural units, where the A's are hydrocarbylene dioxy units of formula [—O—R'—O—] and the B's are hydrocarbylenedicarbonyl units of formula [—C(O)—R"—C(O)—], wherein R' is primarily [—$C_2H_4$—], as in the ethylenedioxy (glycol) unit [—O—$C_2H_4$—O—], and R" is primarily [—$C_6H_4$—], as in the 1,4-phenylenedicarbonyl unit [—C(O)—$C_6H_4$—C(O)—], such as to provide sufficient ethylene terephthalate [—O—$C_2H_4$—O—C(O)—$C_6H_4$—C(O)—] repeat groups so as to maintain the $T_m^o$ between about 240° C. and about 280° C. Suitable poly(ethylene terephthalate)-based polymer (herein denoted as PET or 2GT) may be formed by a DMT-process, e.g., as described by H. Ludewig in his book "Polyester Fibers, Chemistry and Technology", John Wiley and Sons Limited (1971), or by a TPA-process, e.g., as described in Edging U.S. Pat. No. 4,110,316. Included are also copolyesters in which, for example, up to about 15 percent (or even 20 percent) of the hydrocarbylenedioxy and/or hydrocarbylenedicarbonyl units are replaced with different hydrocarbylenedioxy and hydrocarbylenedicarbonyl units to provide enhanced low temperature disperse dyeability, comfort, and aesthetic properties. Suitable replacement units are disclosed, e.g., in Most U.S. Pat. No. 4,444,710 (Example VI), Pacofsky U.S. Pat. No. 3,748,844 (Col. 4), and Hancock, et al. U.S. Pat. No. 4,639,347 (Col. 3).

Polyester polymers, used herein, may, if desired, be modified by incorporating ionic dye sites, such as ethylene-5-M-sulfo-isophthalate residues, where M is an alkali metal cation, for example in the range of about 1 to about 3 mole percent. To adjust the dyeability or other properties of the spin-oriented filaments and the drawn filaments therefrom, some diethylene glycol (DEG) may be added to the polyester polymer as disclosed by Bosley and Duncan U.S. Pat. No. 4,025,592 and in combination with chain-branching agents as described in Goodley and Taylor U.S. Pat. No. 4,945,151. To enhance dyeability with disperse dyes, copolyesters may be used as mentioned in Most U.S. Pat. No. 4,444,710, Pacofsky U.S. Pat. No. 3,748,844, Hancock U.S. Pat. No. 4,639,347, and Frankfort and Knox U.S. Pat. Nos. 4,134,882 and 4,195,051. To overcome the higher shrinkage of copolyester yarns (if considered undesireable for a given end-use), representative branching agents may be used to reduce shrinkage as mentioned in Knox U.S. Pat. No. 4,156,071 , MacLean U.S. Pat. No. 4,092,229, and Reese U.S. Pat. Nos. 4,883,032, 4,996,740, and 5,034,174; and polymer of higher viscosity (e.g., by about +0.5 to about +1.0 LRV units) may be used to control yarn shrinkage (e.g., the extent of crystallization).

Most of the details of the melt-spinning process have been described in U.S. Pat. Nos. 5,250,245 and 5,288,553, so need not be repeated. The polymer is heated to a temperature ($T_P$) and extruded through capillaries of preferred dimensions, as indicated, such that $L/D^4$ is at least 335 $mm^{-3}$, and the freshly-extruded filamentary streams are immediately protected by a short delay shroud (preferably of length 2 to 5 cm), and then quenched, preferably radially, as described by Dauchert in U.S. Pat. No. 3,067,458 and Examples 1, 2 and 11 of Knox U.S. Pat. No. 4,156,071, to form solid filaments that are preferably converged into a single bundle by metered finish tip applicator guides, as described, e.g., by Agers in U.S. Pat. No. 4,926,661, selecting the convergence length ($L_C$) to balance the desire for low downstream air drag (giving high winding tensions) vs. desire for optimum quenching air flow (to provide low DTV and low DS). Typically the withdrawal speed is controlled by use of a feed roll, which preferably cooperates with a let down roll before the windup, using an S-wrap configuration. The single filament bundle is intelaced to provide a unitary interlaced yarn, as described by Bunting and Nelson in U.S. Pat. No. 2,985,995 and by Agers in U.S. Pat. No. 4,926,661. The interlace is conveniently measured by conventional means, e.g., as in Hitt U.S. Pat. No. 3,290,932 or with a Rothschild device to give a pin count, which is an average of several readings.

Generally, untextured filaments and yarns are referred to herein as "flat", and as-spun (undrawn) flat yarns intended for drawing as "feed" or as "draw-feed" yarns. As-spun (undrawn) yarns which can be used as a "textile" yarn without need for further drawing and/or heat treatment are referred to herein as "direct-use" yarns. For textile purposes, a "textile" yarn should generally have certain minimum properties, such as sufficiently high modulus and yield point, and sufficiently low shrinkage, which distinguish such "textile" yarns from conventional feed yarns that require further processing before they have the minimum properties for processing into textiles and subsequent use. It will be recognized that, where appropriate, our technology teaching may apply also to polyester filaments in other forms, such as bundles or tows, which may then be converted into staple fiber, and used as such in accordance with the balance of properties that is desirable and may be achieved as taught hereinafter.

As indicated, a main purpose of the present invention has been to solve the productivity problems and disadvantages of the prior art, namely having to melt spin separate filament bundles of lower number of filaments and having to combine 2 or more such separate filament bundles to provide the desired total yarn denier ($D_Y$) by interlacing or co-mingling such lesser bundles (having less filaments) to provide the desired total yarn denier ($D_Y$) prior to draw-warping or after draw-texturing and, in doing this, to provide filaments of sufficient along-end structural uniformity, measured herein by along-end draw tension variation (DTV, %), along-end denier spread (DS, %), which indicates sufficient physical uniformity, and mechanical quality, as measured by the yarn tenacity-at-break-denier normalized to a polymer LRV of 20.8, for use in textile processing (i.e., providing uniform textile yarns with essentially no broken filaments, herein referred to as "frays"). As indicated, we have achieved this by careful selection of polymer (LRV and $T_m^o$) and process conditions to provide a spin factor (SF) in the range of 0.2 to 1, and especially such that DTV, % is less than 1, e.g. 0.2 to 1, and also between [SF+0.2] and [SF−0.2]; In other words, as indicated hereinbefore, these factors are important, according to the invention:- $\eta_a$, referred to as the "apparent" melt viscosity at temperature $T_P$; $\sigma_F$ the spinline stress factor; and $Q_F$ the quench factor; all three of these should be balanced as indicated, to spin uniform fine dpf HFC yarns from a single spinneret according to the invention.

Fine filament yarns of this invention may be subjected to warp drawing, air-jet texturing, false-twist texturing, gear crimping, and stuffer-box crimping, for example.

Generally, when draw-texturing fine dpf feed yarns on false-twist texturing (FTT) machines that are characterized by a "bent double heater configuration" (such as a Barmag FK900, and herein denoted as Process A), very high Toray Fray Counts (broken filaments) of 500 to 1000 per 1000 meters have been obtained. When, however, we have inserted a device into the draw-texturing threadline to reduce the twist-induced draw by reducing the break angle between the first upstream contact point and the first friction twist insertion point to less than 15 degrees and to increase the radius of curvature of the upstream contact to greater than 2.5 mm, we have significantly reduced (essentially eliminated) the numbers of broken filaments (frays) when texturing on conventional "bent configuration" FTT machines (as shown in Examples 2 and 3); this technique is denoted herein as Process B (according to our invention). For those who have a Barmag FK900 or other "bent configuration" FTT machine, Process B is far preferable to more expensive solutions, such as modifying the "bent configuration" to eliminate this "twist trap" phenomenon by moving the heater and/or spindle, or replacing the existing "bent" machines and buying "tall" linear configuration FTT machines, or buying Murata belt machines, which are more costly solutions than Process B (one aspect of this invention).

Our new filaments (and bundles/tows made therefrom) may be crimped, if desired, and cut into staple and flock. Fabrics made from these improved yarns may be surface-treated by conventional sanding and brushing to give suede-like tactility. Our new low shrinkage filament yarns may be used as direct-use flat textile yarns. The new yarns may be used as feed yarns for air-jet texturing and stuffer-box crimping, wherein no drawing need be carried out. The improved combination of filament strength and uniformity makes these filaments especially suited for end-use processes that require fine filament yarns without broken filaments (or filament breakage), and/or require uniform dyeing with critical dyes. Fine denier filament polyester yarns of the invention are especially suitable for making high-end density moisture-barrier fabrics, such as rainwear and medical garments. The surface of the knit and woven fabrics can be napped (brushed or sanded). To reduce the denier even further, the filaments may be treated (preferably in fabric form) with conventional alkali procedures.

Our new fine filaments, especially those capable of being cationic dyeable, may also be used as coverings for elastomeric yarns (and strips), preferably by air entanglement as described by Strachan in U.S. Pat. No. 3,940,917. The fine filaments of the invention may be co-mingled on-line during spinning or off-line with higher denier polyester (or nylon) filaments to provide for cross-dyed effects and/or mixed-shrinkage post-bulkable potential, where the bulk may be developed off-line, such as overfeeding in presence of heat while beaming/slashing or in fabric form, such as in the dye bath. The degree of interlace and type/amount of finish applied during spinning may generally be selected based on the textile processing needs and final desired yarn/fabric aesthetics. The filament surface frictional characteristics may be changed by selection of cross-section, delusterants, and through such treatments as alkali-etching Further, the frictional characteristics may be enhanced to be more silklike by use of silicon dioxide versus titanium dioxide delusterants. Other inert metal oxides may be used as delusterants. The spin-oriented polyester filaments, used herein, may advantageously be treated with caustic applied to freshly-extruded filaments, as described by Grindstaff and Reese U.S. Pat. Nos. 5,069844, 5069,845 and 5,069,846 to provide the polyester filaments with improved moisture-wicking properties, more akin to those of the nylon filaments.

Indeed, further modifications will be apparent, especially as these and other technologies advance. For example, any type of draw winding machine may be used; post heat treatment of the feed and/or drawn yarns, if desired, may be applied by any type of heating device (such as heated godets, hot air and/or steam jet, passage through a heated tube, microwave heating, etc.); finish application may be applied by convention roll application, herein metered finish tip applicators are preferred and finish may be applied in several steps, for example during spinning prior to drawing and after drawing prior to winding; interlace may be developed by using heated or unheated entanglement air-jets and may be developed in several steps, such as during spinning and during drawing and other devices may be used, such as use of tangle-reeds on a weftless sheet of yarns.

The invention lends itself to further variations and ways to take advantage of the benefits of the yarns of the invention in various drawing and/or heat treatment processes as described hereinafter. As will be understood, feed filaments may be supplied and/or processed according to the invention in the form of a yarn or as a bundle of filaments that does not necessarily have the coherency of a true "yarn", but for convenience herein a plurality of filaments may often be referred to as a yarn or bundle, without intending specific limitation by such term.

TEST METHODS

Many of the test methods are detailed in the "parent" application and in U.S. Pat. Nos. 4,123,882, 4,156,071, 5,066,4475 and in 5,288,553, and are incorporated herein by reference, so further detailed discussion herein would be redundant.

Broken filaments, especially of textured yarns were measured by a commercial Toray Fray Counter (Model DT 104, Toray Industries, Japan) at a linear speed of 700 mpm for 5 minutes i.e., number of frays per 3500 meters, and then the numbers of frays are expressed herein as the number of frays per 1000 meters.

The draw tension variation (DTV) was measured on the DuPont "Draw Tension Instrument"at a draw-ratio of 1.707× for as-spun yarns having elongations of at least 90% at 185° C. over a heater length of 1 meter at 185 ypm (169.2 mpm) wherein Casablanca type rolls (vs. nip rolls) are used to control tension. For information about the DuPont machine and its availability, questions may be directed to the Engineering R&D Division at E. I. DuPont de Nemours and Company, Wilington, Del. 19898. Another instrument brand that uses similar principles (but should be calibrated opposite a DuPont machine) is DYNAFIL, manufactured by TEXTECHNO; this is a fixed-strain device which uses a non-contact heater (length about 30 inches), and normal set up is a 1.6× draw ratio.

The following Examples further illustrate the invention, in showing preparation of multifilament HFC yarns of more than 150 filaments by spinning such filaments in a single bundle from a single spinneret, and subsequent processing of such HFC yarns, and are not intended to be limiting.

EXAMPLE 1

We have spun a large number of multi-filament HFC yarns from 2GT polyester polymer of nominal 21.2 LRV and having a zero-shear melting point $T_m^o$ of 255 C at varying filament extrusion densities (FED). Process and product details of some of these are summarized in Table I. The lowest dpf listed was down to 0.6 dpf (a 150 denier, 250 filament yarn). Such lower dpf as-spun yarns are described hereinafter in Example 4. Comparative items are denoted by the letter C, such as in Item 6C. Yarns having a DTV less than 0.75% are denoted by a letter "P" for preferred. Yarns having denier spread (DS) values in the range of 2 to 2.5% are denoted by the letter "N" (indicating not preferred but according to the invention). Yarns having a preferred normalized tenacity-at-break-denier $(T_B)_n$ of at least 6 g/dd are denoted by a letter "T". Yarns having elongation-to-break ($E_B$) values in the range of 160 to 175% are noted by the letter "E", as such yarns have lower age-stability than draw-feed yarns of lower elongation-to-break, e.g., of 90–160%, (preferably 90–140%). Yarns 1 to 46, 84 to 150, and 159 to 185 were melt-spun using spinneret capillaries of length (L) 36 mil (0.914 mm) and diameter (D) 9 mil (0.229 mm). Yarns 47 to 83 were melt-spun using spinneret capillaries of L×D 21 mil×7 mil (0.533 mm×0.178 mm). Yarns 151 to 158 were melt-spun using spinneret capillaries of L×D 18 mil×6 mil (0.457 mm×0.152 mm). Yarns 1 to 46 were 168 filament yarns spun from a spinneret having a FED of 6.54 #/cm $^2$; yarns 47 to 150 were 200 filament yarns spun from a spinneret having a FED of 7.7 #/cm$^2$; yarns 151 to 158 were 204 filament yarns spun from a spinneret having a FED of 7.94 #/cm$^2$; and yarns 159 to 185 were 250 filament yarns spun from a spinneret having a FED of 9.74 #/cm$^2$.

As indicated (by the Comparative "C" items), we found that the spinning performance of these HFC yarns deteriorated as the FED increased. To overcome this deterioration, our first step was to check and optimize standard process variables and equipment, such as assuring uniform air flow, and optimizing proper convergence length (i.e., long enough to permit convergence without sticky filaments, but short enough to reduce increase in spinline tension from air drag and thereby permit winding up the yarns at lower tensions) and setting the polymer temperature to provide good polymer quality (without thermal degradation). We found this first step improved the spin performance somewhat, but was still sometimes unacceptable. Our next step was to reconsider the extrusion/quenching process. It was unacceptable for us to reduce FED by double-ending (spinning from 2 packs instead from a single pack) since this would cut productivity by 50%. Our objective was to improve yarn mechanical quality $(T_B)_n$, along-end denier (DS), and along-end structure (DTV) without double-ending. The spin factor (SF) expression defines an approach to the spinning process as an integrated system and permits selection of process variables according to our invention, to achieve desired yarn property goals. The next step would be to "fine-tune" by careful selection of process variables so as to maintain spin performance and yarn uniformity/quality, at a higher spin productivity $P_S$ defined by the product of the spin speed ($V_S$) and $(RDR)_S$. Item 14 in Table I is an illustration of the successful use of SF to obtain $(T_B)_n$ greater than 6 g/dd, denier spread (DS) no more than 1% and draw tension variation (DTV, %) no more than 0.75%.

We also observed that the capillaries of L×D 21×7 mil (0.533×0.178 mm) gave an over all better spinning process than the capillaries of L×D 36×9 mil (0.914×0.229 mm) at the same mass flow rate. Capillaries have previously been characterized by their [$L/D^4$] ratio (e.g. in U.S. Pat. No. 4,134,882). In metric units the 6×18 mil, 7×21 mil, and 9×36 mil capillaries have [$L/D^4$, $mm^{-3}$] values of 848, 534 and 335, respectively. According to the process of this invention, [$L/D^4$] metric values of at least 335 are preferred, and at least 500 is especially preferred.

The filament arrays were optimized for uniform quenching (as described in relation to FIG. 3 and in more detail in allowed application Ser. No. 08/214,717 (DP4555-H), referred to above). For calculating the spin factor (SF), those process parameters not included in Table I may be calculated as described hereinbefore. The type and level of spin finish and interlace were selected based on intended end-use; for example, feed yarns for false-twist texturing have lower levels of interlace than those used as feed yarns for draw-warping.

All these yarns are characterized by "random" unitary interlace, i.e., along-end filament entanglement, because all the filaments in each yarn were spun from a single spinneret. Yarns that have been plied have generally contained sections where the original filament bundles have less overall intra-bundle entanglement, i.e., the separately spun bundles retain some of their separate "bundle integrity". This phenomenon has been recognized. For example, when separate bundles of filaments of different polymers (homopolymer and a cationic dyeable modified polymer), dpf, and cross-sections, have been spun and then the separate bundles have been co-mingled into a single interlaced yarn, the along-end mixing has not been as "random" or unitary as if the mixed filaments had been spun from a single extrusion spinneret. This has been a defect of plied yarns, that has led to nonuniform dyed fabrics and poorer down-stream textile processing. Each separately-spun bundle of filaments does not generally entirely lose its "bundle integrity", even after such separately-spun bundles have been interlaced together and mingled into a single yarn. In contrast, the HFC yarns of the invention have shown more unitary interlace because all the filaments of the HFC yarn were spun from a single spinneret; they do not have residual "bundle integrity" from having been spun from different spinnerets. This difference between a plied yarn and a yarn of unitary interlace (all filaments spun from a single spinneret and interlaced therefrom into a single filament bundle only) is demonstrated in Example 6, hereinafter.

EXAMPLE 2

A 255 denier 200 filament draw-feed yarn prepared by melt-spinning 21.2 LRV polyester at 288 C from a spinneret having a FED of 7.8 filaments per $cm^2$, through capillaries of L×D dimensions of 7×21 mil (0.2756 mm×0.8268 mm), the freshly-extruded filaments being protected by a short 3 cm shroud and then quenched using a radial unit having a laminar air flow rate of 22.8 m/min, the quenched filaments being converged into a unitary bundle by use of metered finish tip applicator guides and withdrawn at a spin speed of 2195 m/min, was draw false-twist textured on a Barmag FK900 using polyurethane discs (D-ring), except where indicated, at 450–500 meters per minute by process A (conventional) and by process B (modified threadline path according to one aspect of the invention). Table II summarizes process conditions; namely draw ratio; disc-to-yarn (DY) surface speed ratio was 1.707; heater temperature (Temp, in degrees centigrade); disc stack configuration (C denotes a ceramic disc was used instead of a polyurethane disc); pre/post disc tensions in grams (T1/T2) (no value was measured in some instances); and numbers of broken filaments (Frays per 1000 meters). The draw feed yarns of the invention drawn at a 1.575× draw-ratio at 180° C. using a 1/7/1 disc stack (process B) gave a textured yarn having a yarn denier of 164 (0.82 dpf), a tenacity of 3.69 g/d, and elongation-to-break of 43.5%, giving a normalized $(T_B)_n$ of 5.3 g/dd, according to the invention.

EXAMPLE 3

A 220 denier/325 filament yarn and a 220 denier/250 filament yarn were prepared (essentially as in Example 2, except that the 325 filaments were spun at a FED of 10.3 filaments per $cm^2$, and the 250 filaments at a FED of 9.74 filaments per $cm^2$) and were draw false-twist textured on a Barmag FK900 (which has a "bent" double heater configuration) at 450–500 meters per minute at 160° C., using polyurethane discs (D-ring) with a 1.707 disc/yarn ratio (D/Y), other details being given in Table III. The quality of the textured yarns is represented by the normalized tenacity-at-break-denier $(T_B)_n$ and in the number of "Frays" per 1000 meters. The yarns were textured using the commercial threadline path (Process A) and by a modified threadline path using Process B, discussed hereinbefore. The yarns textured by Process A had $(T_B)_n$ values less than 4 g/dd and fray values significantly greater than 100, in contrast to significantly improved values from Process B (higher $(T_B)_n$ values and very low Fray Counts, less than 10).

EXAMPLE 4

HFC as-spun yarns of filament deniers less than 1 were spun from 2G-T polyester polymer of nominal 21.2 LRV and having a zero-shear melting point $T_m^o$ of 255 C. Process and product details are summarized in Table IV. Yarns having a DTV less than 0.75% are denoted by a letter "P" for preferred. Yarns having a preferred normalized tenacity at break denier $(T_B)_n$ of at least 6 g/dd are denoted by a letter "T". Yarns 1–5 were of 168 filaments and spun from spinnerets having a FED of 6.54/$cm^2$; yarns 6–27 were of 200 filaments and spun from spinnerets having a FED of 7.8/$cm^2$; yarns 28–74 were of 250 filaments and spun from spinnerets having a FED of 9.73/$cm^2$. Yarns 1, 6–17, and 28–50 were spun using 7×21 mil (0.178×0.0.533 mm) spinneret capillaries and yarns 2–5, 18–27, and 50–74 were melt-spun using 9×36 mil (0.229×0.914 mm) spinneret capillaries.

The high filament count yarns in this Example 4 have filament deniers less than 1. Many may be drawn to filament deniers of less than 0.5, and even less than 0.3 dpf. Yarns #s 3 and 5 have boil-off shrinkages of 11.4 and 4.2, respectively, and may be used, if desired, without drawing and heat setting as direct-use yarns, or the yarns may be used as draw-feed yarns, as described in U.S. Pat. Nos. 5,067,447, 5,244,616, 5,145,616, 5,223,197, and 5,250,245.

EXAMPLE 5

Soft bully yarns (and fabrics therefrom) are provided from use of mixed-filament yarns comprised of filaments of differing shrinkages, typically from differences in denier, and/or surface to volume ratio (i.e., cross-sectional shape), with low shrinkage fine filaments (A) providing a desirable soft surface of the bulky yarn and higher denier filaments (B) providing the fabric with improved "body" and "drape" (i.e., less "mushy"). Mixed-shrinkage high filament count yarns of the invention are illustrated for simplicity as being comprised of two filament types of differing $(dpf)_S$. On drawing the spun yarn to an elongation-to-break $(E_B)$ of 25%, for example, the drawn filament deniers $(dpf)_D$ are given by the expression $(dpf)_D=\{(dpf)_S\times[(1.25/(RDR)_S]\}$; wherein the values of $(dpf)_D$ for both filament types are desirably less than 1. To provide for differential shrinkage for round filaments the two filament types should differ in their spun $(dpf)_S$, with the high shrinkage filaments (B) being of higher dpf than of the low shrinkage filaments (A). To spin a single-end high filament count filament bundle of differing $(dpf)_S$, the spinneret capillary dimensions are selected to provide the desired difference, where the ratio of $(dpf)_S$ is related to the ratio of spinneret dimensions according to the expression:

$$(dpf)_B/(dpf)_A=[(L/D^4)_A/(L/D^4)_B]^n,$$

where the exponent "n" equals "1" for Newtonian fluid-like behavior. This can be determined experimentally, by spinning through two capillaries of different dimensions in the same spinneret, by the expression:

$$n=\log_{10}\{(dpf)_A/(dpf)_B\}/\log_{10}\{(L/D^4)_B/(L/D^4)_A\}$$

For non-round cross-sections, spun from short (shape-forming) orifice capillaries after first passing through metering capillaries, the determining value of $(L/D^4)$ has been that of the metering capillaries, rather than of the shape-forming capillaries. As technology advances, however, it is expected that the thickness of the shape-forming plate will be increased, perhaps to a point such that a metering capillary may not be needed. From experimentation, a "round equivalent" $(L/D^4)$ value may be determined for any particular combination of shape-forming odd-cross-section orifice capillary and metering capillary assembly, using a technique similar to that already described.

To avoid broken filaments, it is desirable to draw to elongation-to-break values between 15% and 40%, which can be achieved by selecting a PDR appropriate to the $(RDR)_S$ of the two filament types, where PDR=is the net process draw-ratio=machine draw-ratio×overfeed (or relaxation).

The above mixed-filament micro-denier HFC yarns may be air-jet textured without drawing, or a drawing step may be part of a draw-air-jet (+optional heat relaxation) texturing process.

EXAMPLE 6

A 225 denier, 200 filament draw-feed HFC "unitary" yarn according to the invention was prepared by melt-spinning 21.5 LRV polyester at 288° C. from a single 200-capillary spinneret having a FED of 7.8 filaments per $cm^2$, through capillaries of D×L dimensions of 9×36 mil (0.229 mm×0.914 mm), the freshly-extruded filaments being protected by a short 4.3 cm shroud and then quenched using a radial unit having a laminar air flow rate of 22.8 m/min, the quenched filaments being converged into a unitary bundle by use of a metered finish applicator guide, withdrawn at a speed of 2446 m/min, and the filaments interlaced using an air entanglement jet operating at 36 psig. The air jet used for interlacing the filaments was a standard "stacked" jet, as illustrated generally in Figs. XI and XII of Christini et al. U.S. Pat. No. 3,936,577, that has been in commercial use for some years.

For comparison, a 255 denier 200 filament draw-feed "plied" yarn was prepared by melt-spinning 21.7 LRV polyester at 287° C. through two separate spinnerets, each having a FED of 4.4 filaments per $cm^2$, through capillaries of D×L dimensions of 12×50 mil (0.305 mm×1.27 mm), the freshly extruded filaments being air quenched, and separately converged into two 100-filament bundles by use of metered finish tip applicator guides, and both withdrawn at the same speed of 2624 m/min, and the separate 100-filament bundles were then plied into a 200 filament bundle using the same type of air entanglement jet used for the HFC yarn, said jet operating at 42 psig to achieve a similar average interlace nodes/meter as for the HFC yarn. This yarn is referred to below as the "Plied" yarn.

Six HFC yarn packages and six Plied yarn packages produced as described were analyzed using a Fibrescan FS 100, supplied by Fibre Vision, Inc. to compare interlace character. 66.7 meters of each yarn package were measured at a yarn speed of 1650 m/minute, and the results are recorded in the following Table.

| | Unitary Yarns | Plied Yarns |
|---|---|---|
| Average Number of Nips per Meter | 16.6 | 17.8 |
| Average Distance Between Nips (mm) | 60.1 | 56.2 |
| Average Maximum Distance Between Nips (mm) | 228.6 | 231.7 |

As can be seen, these results seem somewhat comparable, when considering only averages measured over all 6 packages. When, however, the uniformity of the yarns is considered, by noting the maximum distance between nips and the package to package % CV of these maximum distances, the HFC yarn of the invention was shown to have significantly superior uniformity. This significant improvement in along-end uniformity also shows up in better processibility.

| | Unitary Yarns | Plied Yarns |
|---|---|---|
| Maximum Distance Between Nips (mm) | 279.3 | 314.0 |
| Package-to-Package % CV of Maximum Distance Between Nips | 12.6 | 34.0 |

TABLE I

| 0 ITEM NO. | 1 Lq CM | 2 Qa MPM | 3 SPIN MPM | 4 Ps MPM | 5 SPUN DPF | 6 DTV % | 7 DS % | 8 EB, % | 9 TB, G/DD | 10 SF |
|---|---|---|---|---|---|---|---|---|---|---|
| 1 P | 3.0 | 22.8 | 2195 | 5157 | 1.02 | 0.40 | 1.06 | 135.0 | 5.93 | 0.54 |
| 2 P | 3.0 | 22.8 | 2195 | 5170 | 1.20 | 0.53 | 1.03 | 135.6 | 5.87 | 0.63 |
| 3 PT | 4.3 | 22.8 | 2195 | 5566 | 1.01 | 0.63 | 1.45 | 153.6 | 6.46 | 0.74 |

TABLE I-continued

| 0 ITEM NO. | 1 Lq CM | 2 Qa MPM | 3 SPIN MPM | 4 Ps MPM | 5 SPUN DPF | 6 DTV % | 7 DS % | 8 EB, % | 9 TB, G/DD | 10 SF |
|---|---|---|---|---|---|---|---|---|---|---|
| 4 C | 4.3 | 22.8 | 2195 | 5941 | 1.65 | 1.06 | 1.05 | 170.7 | 5.99 | 1.05 |
| 5 C | 6.6 | 22.8 | 2195 | 6134 | 1.50 | 1.19 | 1.00 | 179.5 | 5.93 | 1.22 |
| 6 C | 6.6 | 22.8 | 2195 | 5947 | 1.65 | 1.35 | 1.02 | 171.0 | 5.42 | 1.33 |
| 7 C | 6.6 | 22.8 | 2195 | 5846 | 1.35 | 1.36 | 1.12 | 166.4 | 6.54 | 1.10 |
| 8 HT | 4.3 | 13.7 | 2409 | 6212 | 1.35 | 0.83 | 1.47 | 157.8 | 6.60 | 0.82 |
| 9 C | 6.6 | 13.7 | 2409 | 6409 | 1.35 | 1.13 | 1.24 | 166.0 | 6.67 | 1.04 |
| 10 PT | 3.0 | 22.8 | 2409 | 5922 | 1.12 | 0.53 | 1.28 | 145.8 | 6.15 | 0.59 |
| 11 P | 3.0 | 22.8 | 2409 | 5816 | 1.00 | 0.61 | 1.18 | 141.4 | 6.02 | 0.53 |
| 12 PT | 3.0 | 22.8 | 2409 | 5956 | 1.26 | 0.62 | 1.32 | 147.2 | 6.08 | 0.66 |
| 13 P | 3.0 | 22.8 | 2409 | 5880 | 1.25 | 0.64 | 1.46 | 144.0 | 5.70 | 0.65 |
| 14 HPT | 4.3 | 22.8 | 2409 | 6012 | 1.35 | 0.75 | 0.99 | 149.5 | 6.21 | 0.76 |
| 15 HT | 4.3 | 22.8 | 2409 | 6210 | 1.11 | 0.80 | 1.42 | 157.7 | 6.19 | 0.72 |
| 16 HET | 4.3 | 22.8 | 2409 | 6318 | 1.01 | 0.85 | 1.82 | 162.2 | 6.55 | 0.76 |
| 17 HT | 4.3 | 22.8 | 2409 | 6163 | 1.49 | 0.85 | 1.09 | 155.8 | 6.09 | 0.83 |
| 18 HE | 4.3 | 22.8 | 2409 | 6580 | 1.25 | 0.99 | 1.64 | 173.1 | 6.48 | 0.80 |
| 19 HET | 6.6 | 22.8 | 2409 | 6277 | 1.11 | 0.88 | 1.13 | 160.5 | 6.45 | 0.92 |
| 20 HE | 6.6 | 22.8 | 2409 | 6416 | 1.14 | 0.91 | 1.32 | 166.3 | 5.72 | 0.92 |
| 21 P | 3.0 | 31.9 | 2409 | 5690 | 1.12 | 0.38 | 1.38 | 136.2 | 5.61 | 0.56 |
| 22 HPT | 3.0 | 31.9 | 2409 | 6037 | 1.12 | 0.66 | 1.56 | 150.5 | 6.43 | 0.56 |
| 23 P | 3.0 | 41.0 | 2409 | 5755 | 1.34 | 0.36 | 1.68 | 138.9 | 5.88 | 0.56 |
| 24 HPT | 4.3 | 41.0 | 2409 | 6183 | 1.13 | 0.67 | 1.27 | 156.6 | 6.40 | 0.66 |
| 25 HPT | 4.3 | 41.0 | 2409 | 6376 | 1.13 | 0.77 | 1.31 | 164.6 | 6.68 | 0.66 |
| 26 HPT | 3.0 | 22.8 | 2743 | 6011 | 1.02 | 0.35 | 1.17 | 119.1 | 6.03 | 0.39 |
| 27 HPT | 3.0 | 22.8 | 2743 | 6458 | 1.14 | 0.57 | 1.77 | 135.4 | 6.00 | 0.50 |
| 28 HPT | 3.0 | 22.8 | 2743 | 6855 | 1.00 | 0.60 | 1.99 | 149.9 | 6.61 | 0.44 |
| 29 HPT | 4.3 | 22.8 | 2743 | 6571 | 1.35 | 0.32 | 1.66 | 139.5 | 6.34 | 0.62 |
| 30 HP | 4.3 | 22.8 | 2743 | 6596 | 1.13 | 0.52 | 1.71 | 140.5 | 5.85 | 0.60 |
| 31 HE | 4.3 | 22.8 | 2743 | 7138 | 1.02 | 0.53 | 1.11 | 160.2 | 5.45 | 0.48 |
| 32 HPT | 4.3 | 22.8 | 2743 | 7006 | 1.01 | 0.71 | 1.60 | 155.4 | 7.03 | 0.54 |
| 33 HPT | 6.6 | 22.8 | 2743 | 6407 | 1.01 | 0.50 | 1.36 | 133.6 | 6.26 | 0.68 |
| 34 HP | 6.6 | 22.8 | 2743 | 6152 | 1.02 | 0.53 | 0.96 | 124.3 | 5.41 | 0.61 |
| 35 PT | 6.6 | 22.8 | 2743 | 6672 | 1.35 | 0.67 | 1.25 | 143.2 | 6.12 | 0.80 |
| 36 PT | 3.0 | 22.8 | 3018 | 7124 | 1.01 | 0.45 | 1.67 | 136.1 | 6.28 | 0.39 |
| 37 HP | 3.0 | 22.8 | 3018 | 6523 | 1.19 | 0.45 | 1.33 | 116.2 | 2.76 | 0.40 |
| 38 NP | 4.3 | 22.8 | 3018 | 7018 | 1.01 | 0.41 | 2.18 | 132.6 | 5.31 | 0.47 |
| 37 PT | 4.3 | 22.8 | 3018 | 6801 | 1.20 | 0.45 | 1.31 | 125.4 | 6.18 | 0.49 |
| 40 PT | 6.6 | 22.8 | 3018 | 6930 | 1.20 | 0.51 | 1.18 | 129.7 | 6.08 | 0.62 |
| 41 PT | 6.6 | 22.8 | 3018 | 7402 | 1.01 | 0.53 | 1.36 | 145.3 | 6.41 | 0.60 |
| 42 PT | 6.6 | 22.8 | 3018 | 7673 | 1.01 | 0.74 | 1.62 | 154.3 | 6.41 | 0.60 |
| 43 PT | 3.0 | 22.8 | 3200 | 6919 | 1.19 | 0.39 | 1.26 | 116.2 | 6.64 | 0.37 |
| 44 PT | 3.0 | 22.8 | 3200 | 7064 | 1.00 | 0.44 | 1.42 | 120.7 | 7.06 | 0.35 |
| 45 PT | 3.0 | 22.8 | 3200 | 7295 | 1.01 | 0.57 | 1.57 | 127.9 | 7.31 | 0.35 |
| 46 PT | 4.3 | 22.8 | 3200 | 6917 | 1.02 | 0.39 | 1.08 | 116.1 | 6.25 | 0.38 |
| 47 PT | 6.6 | 22.8 | 3200 | 7055 | 1.02 | 0.44 | 1.13 | 120.5 | 6.31 | 0.49 |
| 48 P | 3.0 | 22.8 | 2195 | 4687 | 1.00 | 0.45 | 1.22 | 113.6 | 5.22 | 0.61 |
| 49 P | 3.0 | 22.8 | 2195 | 5103 | 1.00 | 0.50 | 1.31 | 132.5 | 5.52 | 0.61 |
| 50 P | 3.0 | 22.8 | 2195 | 5038 | 1.01 | 0.57 | 1.09 | 129.6 | 5.41 | 0.61 |
| 51 T | 4.3 | 22.8 | 2195 | 5478 | 1.01 | 0.81 | 1.25 | 149.6 | 6.05 | 0.74 |
| 52 T | 4.3 | 22.8 | 2195 | 5694 | 1.13 | 0.83 | 1.60 | 159.5 | 6.41 | 0.83 |
| 53 T | 4.3 | 22.8 | 2195 | 5798 | 1.13 | 0.92 | 1.59 | 164.2 | 6.25 | 0.83 |
| 54 C | 6.6 | 22.8 | 2195 | 5615 | 1.14 | 1.05 | 1.48 | 155.9 | 6.16 | 1.06 |
| 55 C | 6.6 | 22.8 | 2195 | 6101 | 1.39 | 1.16 | 1.31 | 178.0 | 6.14 | 1.28 |
| 56 P | 3.0 | 13.7 | 2409 | 5686 | 1.14 | 0.72 | 1.93 | 136.0 | 5.73 | 0.65 |
| 57 P | 3.0 | 13.7 | 2409 | 5789 | 1.13 | 0.73 | 1.93 | 140.3 | 5.91 | 0.64 |
| 58 NT | 4.3 | 13.7 | 2409 | 5980 | 1.13 | 0.89 | 2.09 | 148.2 | 6.14 | 0.79 |
| 59 ENT | 4.3 | 13.7 | 2409 | 6290 | 1.14 | 0.97 | 2.06 | 161.1 | 6.48 | 0.79 |
| 60 P | 3.0 | 22.8 | 2409 | 5311 | 1.01 | 0.48 | 1.36 | 120.4 | 5.57 | 0.53 |
| 61 P | 3.0 | 22.8 | 2409 | 5921 | 1.49 | 0.62 | 1.33 | 145.8 | 5.86 | 0.68 |
| 62 PT | 4.3 | 22.8 | 2409 | 5839 | 1.01 | 0.62 | 1.22 | 142.4 | 6.22 | 0.65 |
| 63 | 4.3 | 22.8 | 2409 | 6029 | 1.23 | 0.86 | 1.31 | 150.2 | 5.58 | 0.80 |
| 64 P | 6.6 | 22.8 | 2409 | 5278 | 1.02 | 0.53 | 1.05 | 119.0 | 5.61 | 0.73 |
| 65 PT | 6.6 | 22.8 | 2409 | 6064 | 1.01 | 0.67 | 1.64 | 151.7 | 6.31 | 0.82 |
| 66 T | 6.6 | 22.8 | 2409 | 6171 | 1.01 | 0.80 | 1.26 | 156.1 | 6.61 | 0.82 |
| 67 | 4.3 | 31.9 | 2409 | 6162 | 1.13 | 0.74 | 1.45 | 155.7 | 5.45 | 0.69 |
| 68 PT | 4.3 | 31.9 | 2409 | 5954 | 1.13 | 0.79 | 1.07 | 147.1 | 6.09 | 0.69 |
| 69 ET | 6.6 | 31.9 | 2409 | 6505 | 1.14 | 0.78 | 1.26 | 170.0 | 6.29 | 0.87 |
| 70 | 6.6 | 31.9 | 2409 | 5883 | 1.14 | 0.78 | 1.10 | 144.2 | 5.61 | 0.87 |
| 71 T | 6.6 | 31.9 | 2409 | 6219 | 1.14 | 0.81 | 1.22 | 158.1 | 6.32 | 0.87 |
| 72 N | 6.6 | 31.9 | 2409 | 5919 | 1.11 | 0.91 | 3.20 | 145.7 | 5.99 | 0.87 |
| 73 PT | 3.0 | 22.8 | 2743 | 6514 | 1.19 | 0.44 | 1.48 | 137.5 | 6.25 | 0.46 |
| 74 P | 3.0 | 22.8 | 2743 | 6227 | 1.13 | 0.52 | 1.52 | 127.0 | 5.86 | 0.49 |
| 75 NT | 3.0 | 22.8 | 2743 | 6523 | 1.34 | 0.57 | 2.31 | 137.8 | 6.18 | 0.51 |
| 76 P | 3.0 | 22.8 | 2743 | 6433 | 1.33 | 0.70 | 1.93 | 134.5 | 5.62 | 0.49 |
| 77 PT | 4.3 | 22.8 | 2743 | 6664 | 1.11 | 0.55 | 1.90 | 142.9 | 6.26 | 0.60 |
| 78 PT | 6.6 | 22.8 | 2743 | 6500 | 1.01 | 0.42 | 1.35 | 136.9 | 6.42 | 0.69 |

TABLE I-continued

| 0 ITEM NO. | 1 Lq CM | 2 Qa MPM | 3 SPIN MPM | 4 Ps MPM | 5 SPUN DPF | 6 DTV % | 7 DS % | 8 EB, % | 9 TB, G/DD | 10 SF |
|---|---|---|---|---|---|---|---|---|---|---|
| 79 P | 6.6 | 22.8 | 2743 | 6494 | 1.14 | 0.61 | 1.65 | 136.7 | 5.87 | 0.77 |
| 80 PT | 3.0 | 22.8 | 3018 | 7209 | 1.00 | 0.46 | 1.71 | 138.9 | 6.33 | 0.38 |
| 81 P | 3.0 | 22.8 | 3018 | 6669 | 1.00 | 0.46 | 1.62 | 121.0 | 5.17 | 0.38 |
| 82 PT | 4.3 | 22.8 | 3018 | 7019 | 1.01 | 0.48 | 1.73 | 132.6 | 6.33 | 0.47 |
| 83 P | 3.0 | 22.8 | 3200 | 6589 | 1.01 | 0.47 | 1.25 | 105.9 | 5.56 | 0.45 |
| 84 P | 3.0 | 22.8 | 2195 | 5029 | 1.12 | 0.61 | 1.41 | 129.2 | 5.62 | 0.68 |
| 85 PT | 3.0 | 22.8 | 2195 | 5511 | 1.25 | 0.66 | 1.28 | 151.1 | 6.14 | 0.75 |
| 86 P | 3.0 | 22.8 | 2195 | 5170 | 1.12 | 0.66 | 1.58 | 135.6 | 5.82 | 0.68 |
| 87 P | 3.0 | 22.8 | 2195 | 5570 | 1.34 | 0.67 | 1.24 | 153.8 | 5.63 | 0.71 |
| 88 P | 3.0 | 22.8 | 2195 | 5493 | 1.25 | 0.71 | 1.36 | 150.3 | 5.93 | 0.75 |
| 89 P | 3.0 | 22.0 | 2195 | 4964 | 1.49 | 0.71 | 1.21 | 126.2 | 5.30 | 0.78 |
| 90 | 3.0 | 22.8 | 2195 | 5703 | 1.38 | 0.79 | 1.70 | 159.9 | 5.59 | 0.82 |
| 97 T | 3.0 | 22.8 | 2195 | 5599 | 1.14 | 0.83 | 1.48 | 155.1 | 6.17 | 0.68 |
| 92 | 3.0 | 22.8 | 2195 | 5954 | 1.10 | 0.89 | 1.92 | 171.3 | 5.87 | 0.78 |
| 93 PT | 4.3 | 22.8 | 2195 | 5702 | 1.02 | 0.66 | 0.99 | 159.8 | 6.62 | 0.66 |
| 94 T | 4.3 | 22.8 | 2195 | 5565 | 1.00 | 0.77 | 1.35 | 153.6 | 6.16 | 0.74 |
| 95 T | 4.3 | 22.8 | 2195 | 5820 | 1.20 | 0.77 | 1.12 | 165.2 | 6.79 | 0.77 |
| 96 | 4.3 | 22.8 | 2195 | 5418 | 1.01 | 0.78 | 1.77 | 146.9 | 5.91 | 0.87 |
| 97 T | 4.3 | 22.8 | 2195 | 5664 | 1.13 | 0.83 | 1.43 | 158.1 | 6.26 | 0.82 |
| 98 | 4.3 | 22.8 | 2195 | 5511 | 1.26 | 0.96 | 1.35 | 151.1 | 5.84 | 0.92 |
| 99 T | 6.6 | 22.8 | 2195 | 5603 | 1.01 | 0.84 | 1.14 | 155.3 | 6.02 | 0.95 |
| 100 T | 6.6 | 22.8 | 2195 | 5572 | 1.02 | 0.92 | 1.14 | 153.9 | 6.08 | 0.95 |
| 101 T | 6.6 | 22.8 | 2195 | 5817 | 1.20 | 0.93 | 0.94 | 165.1 | 6.27 | 0.98 |
| 102 T | 6.6 | 22.8 | 2195 | 5765 | 1.01 | 0.94 | 1.35 | 162.7 | 6.34 | 0.94 |
| 103 C | 6.6 | 22.8 | 2195 | 6061 | 1.39 | 1.10 | 1.57 | 1.76 | 6.18 | 1.28 |
| 104 C | 6.6 | 22.8 | 2195 | 5949 | 1.26 | 1.11 | 1.17 | 171.1 | 6.26 | 1.16 |
| 105 PN | 3.0 | 13.7 | 2409 | 5696 | 1.12 | 0.52 | 2.04 | 136.4 | 5.87 | 0.64 |
| 106 PT | 3.0 | 22.8 | 2409 | 5689 | 1.00 | 0.40 | 1.43 | 136.1 | 6.28 | 0.53 |
| 107 P | 3.0 | 22.8 | 2409 | 5343 | 1.20 | 0.41 | 1.32 | 121.7 | 5.54 | 0.55 |
| 108 PT | 3.0 | 22.8 | 2409 | 5602 | 1.02 | 0.45 | 1.01 | 132.5 | 6.44 | 0.47 |
| 109 P | 3.0 | 22.8 | 2409 | 5474 | 1.14 | 0.50 | 1.34 | 127.2 | 5.71 | 0.60 |
| 110 P | 3.0 | 22.8 | 2409 | 5522 | 1.23 | 0.53 | 1.29 | 129.2 | 5.59 | 0.66 |
| 111 P | 3.0 | 22.8 | 2409 | 5686 | 1.00 | 0.58 | 1.96 | 136.0 | 5.96 | 0.62 |
| 112 P | 3.0 | 22.8 | 2409 | 5268 | 1.25 | 0.60 | 1.52 | 118.6 | 5.35 | 0.65 |
| 113 P | 4.3 | 22.8 | 2409 | 5832 | 1.13 | 0.59 | 1.44 | 142.1 | 5.86 | 0.72 |
| 114 PT | 4.3 | 22.8 | 2409 | 5816 | 1.02 | 0.61 | 0.98 | 141.4 | 6.47 | 0.58 |
| 115 PT | 4.3 | 22.8 | 2409 | 5681 | 1.01 | 0.64 | 1.66 | 135.8 | 6.27 | 0.65 |
| 116 PT | 4.3 | 22.8 | 2409 | 5752 | 1.20 | 0.64 | 1.23 | 138.7 | 6.12 | 0.67 |
| 117 P | 4.3 | 22.8 | 2409 | 5385 | 1.13 | 0.70 | 1.49 | 123.5 | 5.34 | 0.72 |
| 118 P | 4.3 | 22.8 | 2409 | 5665 | 1.13 | 0.73 | 1.24 | 135.1 | 5.28 | 0.72 |
| 119 PT | 4.3 | 22.8 | 2409 | 6094 | 1.26 | 0.76 | 1.66 | 152.9 | 6.41 | 0.80 |
| 120 PT | 6.6 | 22.8 | 2409 | 5937 | 1.01 | 0.67 | 1.33 | 146.4 | 6.23 | 0.83 |
| 121 PT | 6.6 | 22.8 | 2409 | 6032 | 1.14 | 0.75 | 1.09 | 150.4 | 6.24 | 0.92 |
| 122 | 6.6 | 22.8 | 2409 | 5890 | 1.13 | 0.82 | 1.24 | 144.5 | 5.60 | 0.92 |
| 123 T | 6.6 | 22.8 | 2409 | 6096 | 1.21 | 0.88 | 1.14 | 153.0 | 6.09 | 0.86 |
| 124 P | 3.0 | 31.9 | 2409 | 5679 | 1.14 | 0.44 | 1.14 | 135.7 | 5.92 | 0.57 |
| 125 PT | 3.0 | 31.9 | 2409 | 5792 | 1.13 | 0.49 | 1.19 | 140.4 | 6.20 | 0.56 |
| 126 PT | 3.0 | 31.9 | 2409 | 5814 | 1.34 | 0.52 | 1.09 | 141.3 | 6.02 | 0.59 |
| 127 PT | 4.3 | 31.9 | 2409 | 5931 | 1.13 | 0.62 | 1.71 | 146.2 | 6.25 | 0.69 |
| 128 PT | 4.3 | 31.9 | 2409 | 6101 | 1.35 | 0.74 | 1.28 | 153.2 | 6.32 | 0.72 |
| 129 | 6.6 | 31.9 | 2409 | 5909 | 1.35 | 0.80 | 1.48 | 145.2 | 5.77 | 0.91 |
| 130 P | 3.0 | 41.0 | 2409 | 5614 | 1.13 | 0.30 | 1.55 | 133.0 | 5.67 | 0.54 |
| 131 P | 3.0 | 41.0 | 2409 | 5703 | 1.14 | 0.46 | 1.18 | 136.7 | 5.89 | 0.54 |
| 132 P | 3.0 | 41.0 | 2409 | 5555 | 1.12 | 0.47 | 1.28 | 130.5 | 5.77 | 0.54 |
| 133 P | 4.3 | 41.0 | 2409 | 5962 | 1.11 | 0.63 | 1.18 | 147.4 | 5.97 | 0.66 |
| 134 P | 6.6 | 41.0 | 2409 | 5870 | 1.14 | 0.67 | 1.16 | 143.6 | 5.92 | 0.84 |
| 135 T | 6.6 | 41.0 | 2409 | 6104 | 1.14 | 0.81 | 1.47 | 153.3 | 6.16 | 0.84 |
| 136 HT | 6.6 | 41.0 | 2409 | 6172 | 1.14 | 0.85 | 1.06 | 156.2 | 6.45 | 0.84 |
| 137 HPT | 3.0 | 22.8 | 2743 | 6529 | 1.01 | 0.46 | 1.66 | 138.0 | 6.25 | 0.44 |
| 138 HPT | 3.0 | 22.8 | 2743 | 6564 | 1.00 | 0.55 | 1.96 | 139.3 | 6.28 | 0.44 |
| 139 HPT | 4.3 | 22.8 | 2743 | 6485 | 1.12 | 0.46 | 1.83 | 136.4 | 6.11 | 0.60 |
| 140 HPT | 4.3 | 22.8 | 2743 | 6367 | 1.12 | 0.50 | 1.79 | 132.1 | 6.00 | 0.60 |
| 141 HPT | 4.3 | 22.8 | 2743 | 6501 | 1.20 | 0.50 | 1.18 | 137.0 | 6.42 | 0.56 |
| 142 HPT | 4.3 | 22.8 | 2743 | 6087 | 1.00 | 0.69 | 2.00 | 121.9 | 5.55 | 0.54 |
| 143 HPT | 4.3 | 22.8 | 2743 | 6464 | 1.03 | 0.70 | 1.54 | 135.6 | 6.48 | 0.55 |
| 144 HP | 6.6 | 22.8 | 2743 | 6348 | 1.01 | 0.55 | 1.59 | 131.4 | 5.98 | 0.68 |
| 145 HPT | 6.6 | 22.8 | 2743 | 6479 | 1.20 | 0.57 | 1.08 | 136.2 | 6.07 | 0.71 |
| 146 HP | 6.6 | 22.8 | 2743 | 6638 | 1.12 | 0.60 | 1.98 | 142.0 | 5.87 | 0.77 |
| 147 HPT | 6.6 | 22.8 | 2743 | 6561 | 1.14 | 0.68 | 1.53 | 139.2 | 6.22 | 0.76 |
| 148 HPT | 6.6 | 22.8 | 2743 | 6754 | 1.14 | 0.70 | 1.76 | 146.2 | 6.51 | 0.76 |
| 149 HP | 4.3 | 22.8 | 3018 | 6521 | 1.00 | 0.58 | 1.95 | 116.1 | 5.70 | 0.47 |
| 150 T | 4.3 | 22.8 | 2195 | 5789 | 1.11 | 0.78 | 1.28 | 163.8 | 6.34 | 0.82 |
| 151 C | 6.6 | 22.8 | 2195 | 4868 | 1.26 | 1.01 | 1.16 | 167.4 | 6.11 | 1.17 |
| 152 HT | 4.3 | 22.8 | 2409 | 6078 | 1.26 | 0.86 | 1.45 | 152.3 | 6.14 | 0.80 |
| 153 HPT | 4.3 | 31.9 | 2409 | 6089 | 1.11 | 0.73 | 1.27 | 152.7 | 6.13 | 0.68 |

TABLE I-continued

| 0 ITEM NO. | 1 Lq CM | 2 Qa MPM | 3 SPIN MPM | 4 Ps MPM | 5 SPUN DPF | 6 DTV % | 7 DS % | 8 EB, % | 9 TB, G/DD | 10 SF |
|---|---|---|---|---|---|---|---|---|---|---|
| 154 PT | 4.3 | 41.0 | 2409 | 5947 | 1.13 | 0.55 | 1.30 | 146.8 | 6.11 | 0.66 |
| 155 HPT | 4.3 | 41.0 | 2409 | 6026 | 1.35 | 0.63 | 1.20 | 150.1 | 6.10 | 0.69 |
| 156 HT | 6.6 | 41.0 | 2409 | 6267 | 1.35 | 0.97 | 1.03 | 160.1 | 6.28 | 0.87 |
| 157 PT | 3.0 | 22.8 | 2195 | 5835 | 1.11 | 0.62 | 1.55 | 165.9 | 6.18 | 0.68 |
| 158 PT | 3.0 | 22.8 | 2195 | 5616 | 1.24 | 0.68 | 1.67 | 155.9 | 6.12 | 0.75 |
| 159 | 3.0 | 22.8 | 2195 | 5580 | 1.64 | 0.88 | 1.30 | 154.3 | 5.65 | 0.86 |
| 160 | 3.0 | 22.8 | 2195 | 5766 | 1.36 | 0.96 | 1.69 | 162.7 | 5.49 | 0.83 |
| 161 | 4.3 | 22.8 | 2195 | 5750 | 1.11 | 0.91 | 1.72 | 162.0 | 5.85 | 0.96 |
| 162 T | 4.3 | 22.8 | 2195 | 5892 | 1.26 | 0.93 | 1.45 | 168.5 | 6.60 | 0.92 |
| 163 PT | 6.6 | 22.8 | 2195 | 5445 | 1.03 | 0.53 | 1.01 | 148.1 | 6.36 | 0.84 |
| 164 C | 6.6 | 22.8 | 2195 | 5829 | 1.23 | 1.17 | 1.72 | 165.6 | 6.10 | 1.16 |
| 165 C | 6.6 | 22.8 | 2195 | 5934 | 1.36 | 1.31 | 2.85 | 170.4 | 5.76 | 1.27 |
| 166 NP | 3.0 | 13.7 | 2409 | 5783 | 1.11 | 0.72 | 2.66 | 140.0 | 5.93 | 0.65 |
| 167 PT | 3.0 | 22.8 | 2409 | 5843 | 1.34 | 0.38 | 1.25 | 142.5 | 6.04 | 0.62 |
| 168 P | 3.0 | 22.8 | 2409 | 5684 | 1.11 | 0.39 | 1.51 | 135.9 | 5.90 | 0.59 |
| 169 PT | 4.3 | 22.8 | 2409 | 5959 | 1.01 | 0.60 | 1.97 | 147.3 | 6.13 | 0.77 |
| 170 P | 3.0 | 41.0 | 2409 | 5698 | 1.11 | 0.38 | 1.40 | 136.5 | 5.84 | 0.54 |
| 171 HT | 6.6 | 41.0 | 2409 | 6192 | 1.11 | 0.80 | 1.62 | 157.0 | 6.39 | 0.83 |
| 172 HPT | 3.0 | 22.8 | 2743 | 6559 | 1.11 | 0.39 | 1.65 | 139.1 | 6.51 | 0.49 |
| 173 P | 3.0 | 22.8 | 2195 | 5464 | 1.01 | 0.64 | 1.58 | 149.0 | 5.99 | 0.72 |
| 174 | 3.0 | 22.8 | 2195 | 5725 | 1.11 | 0.80 | 1.66 | 160.9 | 5.45 | 0.79 |
| 175 PT | 4.3 | 22.8 | 2195 | 5616 | 1.01 | 0.70 | 1.63 | 155.9 | 6.00 | 0.87 |
| 176 C | 6.6 | 22.8 | 2195 | 6055 | 1.01 | 1.32 | 2.45 | 175.9 | 6.31 | 1.11 |
| 177 C | 6.6 | 22.8 | 2195 | 5774 | 1.11 | 1.37 | 2.30 | 163.1 | 5.47 | 1.21 |
| 178 PT | 3.0 | 13.7 | 2409 | 5908 | 1.34 | 0.60 | 1.69 | 145.2 | 6.22 | 0.67 |
| 179 NT | 3.0 | 22.8 | 2195 | 5419 | 1.0 | 0.56 | 2.01 | 146.9 | 6.12 | 0.71 |
| 180 | 3.0 | 22.8 | 2195 | 5583 | 1.39 | 0.78 | 1.33 | 154.4 | 5.82 | 0.83 |
| 181 | 3.0 | 22.8 | 2195 | 5618 | 1.38 | 0.89 | 1.60 | 156.0 | 5.59 | 0.82 |
| 182 | 4.3 | 22.8 | 2195 | 5413 | 1.34 | 0.85 | 1.35 | 146.7 | 5.68 | 0.86 |
| 183 C | 6.6 | 22.8 | 2195 | 5796 | 1.11 | 1.25 | 1.75 | 164.1 | 5.73 | 1.21 |
| 184 C | 6.6 | 22.8 | 2195 | 5774 | 1.01 | 1.49 | 4.73 | 163.1 | 5.76 | 1.11 |
| 185 PT | 4.3 | 22.8 | 2409 | 5635 | 1.00 | 0.58 | 1.70 | 133.9 | 6.06 | 0.64 |

TABLE II

| Item No. | Process Type | Temp °C. | T1/T2 | Disc Stack | Draw Ratio | # Frays 1000 m |
|---|---|---|---|---|---|---|
| 1 | A | 160 | 30/10 | 1/7/1 | 1.409 | 10.3 |
| 2 | A | 170 | — | 1/71/ | 1.409 | 15.1 |
| 3 | A | 170 | 35/10 | 1/7/1 | 1.478 | 16.0 |
| 4 | A | 170 | — | 1/7/1 | 1.478 | 22.9 |
| 5 | A | 180 | 32/8 | 1C/7/1 | 1.478 | 9.4 |
| 6 | B | 180 | 32/8 | 1/7/1 | 1.478 | 0 |
| 7 | B | 170 | — | 1/7/1 | 1.478 | 0 |
| 8 | B | 180 | — | 1/7/1 | 1.478 | 0 |
| 9 | B | 190 | — | 1/7/1 | 1.478 | 0.1 |
| 10 | B | 200 | — | 1/7/1 | 1.478 | 0.3 |

TABLE II-continued

| Item No. | Process Type | Temp °C. | T1/T2 | Disc Stack | Draw Ratio | # Frays 1000 m |
|---|---|---|---|---|---|---|
| 11 | B | 200 | —/28 | 2/4/1 | 1.487 | 5.7 |
| 12 | B | 200 | —/12 | 2/6/1 | 1.487 | 0.4 |
| 13 | B | 200 | — | 1/4/1 | 1.487 | 5.7 |
| 14 | B | 200 | —/17 | 2/6/1 | 1.575 | 5.2 |
| 15 | B | 200 | —/14 | 1/7/1 | 1.575 | 2.0 |
| 16 | B | 290 | — | 1/7/1 | 1.575 | 1.4 |
| 17 | B | 180 | — | 1/7/1 | 1.575 | 0.7 |
| 18 | A | 180 | — | 2/6/1 | 1.575 | 200 |

TABLE III

| Feed yarn Properties | | | Draw Texturing Process | | | Textured Yarn Properties | | | |
|---|---|---|---|---|---|---|---|---|---|
| Yarn Count | (dpf)s | Type | T1/T2 | Disc Stack | Draw Ratio | $(dpf)_D$ | Eb % | TBn g/dd | # Frays 1000 m |
| 220–325 | 0.69 | A | 52/54 | 2/5/1 | 1.409 | 0.51 | 13.9 | 1.79 | 954 |
| 220–325 | 0.69 | B | 55/54 | 1/7/1 | 1.379 | 0.51 | 38.8 | 4.22 | 1.4 |
| 220–250 | 0.88 | A | 38/20 | 2/5/1 | 1.409 | 0.66 | 29.5 | 3.23 | 474 |
| 220–250 | 0.88 | B | 50/40 | 1/7/1 | 1.379 | 0.66 | 50.8 | 5.08 | 1.4 |

TABLE IV

| 0 ITEM No. | 1 Lq CM | 2 Qa MPM | 3 SPIN MPM | 4 SPUN DPF | 5 DTV % | 6 DS % | 7 EB % | 8 TBn G/DD | 9 SF |
|---|---|---|---|---|---|---|---|---|---|
| 1 P | 4.32 | 31.9 | 2408 | 0.91 | 0.48 | 1.32 | 141 | 5.80 | 0.66 |
| 2 T | 3.05 | 22.8 | 2408 | 0.90 | 0.75 | 1.00 | 123 | 6.04 | 0.42 |
| 3 P | 3.05 | 22.8 | 2742 | 0.60 | 0.33 | 1.94 | 104 | 5.54 | 0.32 |
| 4 PT | 4.32 | 22.8 | 2742 | 0.90 | 0.63 | 1.13 | 129 | 6.47 | 0.43 |
| 5 PT | 4.32 | 22.8 | 3656 | 0.90 | 0.44 | 1.47 | 103 | 6.04 | 0.28 |
| 6 P | 3.05 | 22.8 | 2194 | 0.86 | 0.45 | 1.01 | 125 | 5.67 | 0.52 |
| 7 PT | 4.32 | 22.8 | 2408 | 0.76 | 0.56 | 1.13 | 132 | 6.33 | 0.49 |
| 8 PT | 3.05 | 41.0 | 2408 | 0.91 | 0.45 | 1.29 | 136 | 6.23 | 0.52 |
| 9 P | 3.05 | 22.8 | 2742 | 0.86 | 0.40 | 1.09 | 111 | 5.54 | 0.38 |
| 10 PT | 3.05 | 22.8 | 2742 | 0.76 | 0.45 | 1.24 | 113 | 6.00 | 0.34 |
| 11 P | 4.32 | 22.8 | 2742 | 0.76 | 0.49 | 1.38 | 108 | 5.28 | 0.41 |
| 12 P | 4.32 | 22.8 | 2742 | 0.86 | 0.53 | 1.41 | 121 | 5.82 | 0.46 |
| 13 PT | 3.05 | 22.8 | 3016 | 0.81 | 0.35 | 1.65 | 123 | 6.54 | 0.37 |
| 14 P | 4.32 | 22.8 | 3016 | 0.81 | 0.67 | 1.95 | 109 | 5.05 | 0.45 |
| 15 PT | 4.32 | 22.8 | 3199 | 0.86 | 0.39 | 1.44 | 120 | 6.51 | 0.37 |
| 16 P | 6.60 | 22.8 | 3199 | 0.86 | 0.43 | 1.23 | 116 | 5.62 | 0.47 |
| 17 P | 3.05 | 22.8 | 2194 | 0.85 | 0.52 | 1.03 | 129 | 5.94 | 0.52 |
| 18 PT | 3.05 | 22.8 | 2408 | 0.68 | 0.39 | 1.56 | 132 | 6.69 | 0.43 |
| 19 P | 3.05 | 22.8 | 2408 | 0.85 | 0.54 | 1.31 | 119 | 5.71 | 0.45 |
| 20 PT | 4.32 | 22.8 | 2408 | 0.76 | 0.44 | 1.19 | 131 | 6.53 | 0.49 |
| 21 P | 6.60 | 22.8 | 2408 | 0.86 | 0.56 | 1.17 | 142 | 5.96 | 0.71 |
| 22 P | 3.05 | 22.8 | 2742 | 0.75 | 0.32 | 1.14 | 113 | 5.96 | 0.33 |
| 23 P | 3.05 | 22.8 | 2742 | 0.85 | 0.51 | 1.12 | 113 | 5.31 | 0.38 |
| 24 P | 4.32 | 22.8 | 2742 | 0.86 | 0.53 | 1.29 | 120 | 5.83 | 0.46 |
| 25 P | 4.32 | 22.8 | 2742 | 0.91 | 0.54 | 1.79 | 126 | 5.73 | 0.57 |
| 26 P | 6.60 | 22.8 | 2742 | 0.86 | 0.60 | 1.16 | 132 | 6.59 | 0.59 |
| 27 PT | 6.60 | 22.8 | 3199 | 0.86 | 0.40 | 0.90 | 113 | 5.20 | 0.47 |
| 28 P | 6.60 | 22.8 | 2408 | 0.99 | 0.73 | 1.08 | 148 | 6.31 | 0.82 |
| 29 | 3.05 | 22.8 | 2194 | 0.91 | 0.77 | 1.76 | 155 | 5.78 | 0.65 |
| 30 PT | 4.32 | 22.8 | 2194 | 0.86 | 0.67 | 1.10 | 148 | 6.52 | 0.64 |
| 31 T | 4.32 | 22.8 | 2194 | 0.91 | 0.77 | 1.63 | 153 | 6.08 | 0.79 |
| 32 PR | 3.05 | 22.8 | 2408 | 0.61 | 0.50 | 1.48 | 121 | 6.24 | 0.39 |
| 33 PR | 3.05 | 22.8 | 2408 | 0.69 | 0.56 | 1.40 | 129 | 6.41 | 0.43 |
| 34 PR | 3.05 | 22.8 | 2408 | 0.81 | 0.62 | 1.47 | 132 | 6.33 | 0.51 |
| 35 PR | 3.05 | 22.8 | 2408 | 0.91 | 0.62 | 1.74 | 141 | 6.43 | 0.57 |
| 36 P | 4.32 | 22.8 | 2408 | 0.81 | 0.35 | 1.59 | 127 | 5.40 | 0.62 |
| 37 PR | 4.32 | 22.8 | 2408 | 0.86 | 0.39 | 1.20 | 139 | 6.42 | 0.55 |
| 38 P | 4.32 | 22.8 | 2408 | 0.61 | 0.50 | 1.43 | 123 | 5.96 | 0.47 |
| 39 P | 4.32 | 22.8 | 2408 | 0.69 | 0.50 | 1.45 | 129 | 5.82 | 0.53 |
| 40 P | 4.32 | 22.8 | 2408 | 0.91 | 0.55 | 1.78 | 134 | 5.54 | 0.69 |
| 41 PR | 3.05 | 31.9 | 2408 | 0.91 | 0.34 | 1.31 | 139 | 6.23 | 0.54 |
| 42 T | 4.32 | 41.0 | 2408 | 0.91 | 0.49 | 1.52 | 146 | 6.28 | 0.63 |
| 43 PT | 3.05 | 22.8 | 2742 | 0.61 | 0.34 | 1.54 | 105 | 5.59 | 0.32 |
| 44 P | 3.05 | 22.8 | 2742 | 0.91 | 0.52 | 1.79 | 120 | 5.65 | 0.47 |
| 45 PT | 3.05 | 22.8 | 2742 | 0.81 | 0.57 | 1.67 | 121 | 6.11 | 0.42 |
| 46 P | 4.32 | 22.8 | 2742 | 0.61 | 0.48 | 1.60 | 109 | 5.66 | 0.39 |
| 47 PT | 4.32 | 22.8 | 2742 | 0.81 | 0.64 | 1.86 | 130 | 6.28 | 0.51 |
| 48 P | 4.32 | 22.8 | 2742 | 0.91 | 0.68 | 1.64 | 131 | 5.57 | 0.57 |
| 49 PT | 6.60 | 22.8 | 2742 | 0.86 | 0.53 | 1.27 | 138 | 6.06 | 0.59 |
| 50 | 6.60 | 22.8 | 3016 | 0.81 | 0.77 | 2.64 | 121 | 5.81 | 0.57 |
| 51 PT | 3.05 | 22.8 | 2194 | 0.90 | 0.54 | 1.89 | 157 | 6.06 | 0.64 |
| 52 PT | 4.32 | 22.8 | 2194 | 0.86 | 0.54 | 1.49 | 143 | 6.49 | 0.63 |
| 53 T | 4.32 | 22.8 | 2194 | 0.91 | 0.82 | 1.72 | 152 | 6.16 | 0.79 |
| 54 P | 3.05 | 22.8 | 2408 | 0.80 | 0.46 | 2.16 | 126 | 5.80 | 0.50 |
| 55 PT | 3.05 | 22.8 | 2408 | 0.90 | 0.59 | 1.96 | 137 | 6.24 | 0.56 |
| 56 P | 4.32 | 22.8 | 2408 | 0.86 | 0.45 | 1.09 | 135 | 5.58 | 0.56 |
| 57 P | 4.32 | 22.8 | 2408 | 0.91 | 0.52 | 1.52 | 137 | 5.78 | 0.69 |
| 58 P | 4.32 | 22.8 | 2408 | 0.81 | 0.55 | 1.98 | 125 | 5.41 | 0.62 |
| 59 PT | 4.32 | 22.8 | 2408 | 0.69 | 0.62 | 1.73 | 126 | 6.13 | 0.53 |
| 60 | 6.60 | 22.8 | 2408 | 0.81 | 0.77 | 2.00 | 131 | 5.53 | 0.78 |
| 61 PT | 3.05 | 31.9 | 2408 | 0.90 | 0.40 | 1.53 | 139 | 6.54 | 0.53 |
| 62 | 4.32 | 31.9 | 2408 | 0.91 | 0.63 | 1.97 | 142 | 6.19 | 0.66 |
| 63 PT | 3.05 | 41.0 | 2408 | 0.90 | 0.42 | 1.21 | 140 | 6.58 | 0.51 |
| 64 PT | 4.32 | 41.0 | 2408 | 0.91 | 0.38 | 1.21 | 140 | 6.16 | 0.63 |
| 65 PT | 3.05 | 22.8 | 2742 | 0.90 | 0.33 | 1.20 | 121 | 6.34 | 0.35 |
| 66 PT | 3.05 | 22.8 | 2742 | 0.80 | 0.41 | 2.22 | 138 | 6.39 | 0.42 |
| 67 PT | 4.32 | 22.8 | 2742 | 0.76 | 0.35 | 1.39 | 116 | 6.00 | 0.41 |
| 68 PT | 4.32 | 22.8 | 2742 | 0.61 | 0.42 | 1.64 | 115 | 6.12 | 0.39 |
| 69 P | 4.32 | 22.8 | 2742 | 0.81 | 0.63 | 1.75 | 117 | 5.72 | 0.51 |
| 70 | 6.60 | 22.8 | 2742 | 0.81 | 0.83 | 1.67 | 127 | 5.88 | 0.65 |
| 71 P | 4.32 | 22.8 | 3016 | 0.81 | 0.62 | 1.96 | 116 | 5.98 | 0.45 |
| 72 | 6.60 | 22.8 | 3016 | 0.81 | 0.78 | 1.93 | 109 | 5.02 | 0.57 |
| 73 PT | 4.32 | 22.8 | 3199 | 0.86 | 0.46 | 1.59 | 138 | 6.00 | 0.37 |
| 74 PT | 4.32 | 22.8 | 2408 | 0.90 | 0.49 | 0.97 | 140 | 6.74 | 0.51 |

We claim:

1. A process of preparing an interlaced multifilament yarn of at least 150 fine filaments in number and of 0.5 to 2.2 spun denier per filament $(dpf)_S$, from a polyester polymer of 13 to 23 relative viscosity(LRV) and of 240° C. to 265° C. zero-shear melting point ($T_m^o$) comprising :

(i) melting the polyester polymer, heating the resulting melt to a polymer temperature (Tp) that is 25° C. to 55° C. above the $T_m^o$, and filtering the heated melt;

(ii) extruding the filtered melt through at least 150 capillaries in the face of a spinneret to form at least 150 filamentary streams at a filamentary extrusion density (FED) of at least 6 filaments/cm$^2$ and at a total melt mass flow rate W, in g/min, where $W=(dpf)_S (V_S)/9000$ times the number of filaments and $V_S$ is the spinning withdrawal speed and is at least 2 Km/min;

(iii) protecting the freshly-extruded filamentary streams immediately below the face of the spinneret by a delay shroud (of length $L_q$ cm below said face), then cooling them by quenching air of laminar velocity ($Q_a$ m/min), such that the Spin Factor (SF) is 0.2 to 1, where said Spin Factor (SF) is calculated according to the expression:

$$SF=k\{(LRV)[(T_m^o+25)/(Tp)]^6[(V_S)^2/(dpf)_S][(Q_a/W)^{0.2}][(FED)(L_q)]^{-0.7}]\}^n$$

where "k"=$2.4\times10^{+5}$ and 'n'=minus (−) 0.8;

(iv) cooling the filamentary streams to a temperature below the glass transition temperature ($T_g$), converging the resulting cooled filaments into a single multifilament bundle of at least 150 filaments at a convergence distance ($L_c$, in cm) from the face of the spinneret, and interlacing the single multifilament bundle to provide an interlaced spin-oriented yarn;

and wherein the interlaced yarn is wound to form a package at a winding speed of 2 to 5 Km/min.

2. A process according to claim 1, wherein the polymer and process conditions are selected to provide a spin-oriented yarn that has an along-end draw tension variation (DTV, %) of less than 1%; a normalized tenacity-at-break-denier $(T_B)_n$ of at least 5 grams/drawn denier (g/dd), where $(T_B)_n$=Tenacity(g/d)$(RDR)_S$ $(20.8/LRV)^{0.75}$, where $(RDR)_S$ is the residual spun draw ratio and is defined by $(RDR)_S=[1+(E_B)/100]$, where $(E_B)$ is the percentage elongation-to-break; and an along-end denier spread (DS) of less than 2.5%.

3. A process according to claim 1, wherein the polymer and process conditions are selected to provide a spin-oriented yarn that has an along-end draw tension variation (DTV, %) of less than 1 and between [SF+0.2] and [SF−0.2], SF being the spin factor, as defined; a residual draw ratio $(RDR)_S$ between about 1.9 and 2.6, where $(RDR)_S$ is the residual spun draw ratio and is defined by $(RDR)_S=[1+(E_B)/100]$, where $(E_B)$ is the percentage elongation-to-break; and a $(1-S/S_m)$ value of greater than 0.05, where S is the boil-off shrinkage and $S_m$ is the maximum shrinkage potential.

4. A process according to any one of claims 1 to 3, wherein the filament extrusion density (FED) is least 6.5 filaments per cm$^2$.

5. A process according to any one of claims 1 to 3, wherein the spin-oriented yarn is drawn by a draw ratio such as to provide a drawn yarn of elongation to-break $(E_B)$ 15 to 40%, and of drawn filament denier about 1 or less.

6. A process according to claim 5, wherein a plurality of such spin-oriented yarns are drawn in the form of a weftless warp sheet.

7. A process according to claim 5, wherein the drawing of the spin-oriented yarn is coupled with the melt-spinning, whereby the resulting drawn yarn is wound to form a package at a winding speed of 3 to 5 Km/min.

8. A process according to claim 1, wherein the polymer and process conditions are selected to provide a yarn that has a $(1-S/S_m)$-value greater than 0.85, where S is the boil-off shrinkage and $S_m$ is the maximum shrinkage potential.

9. A process according to any one of claims 1 to 3, wherein the spin-oriented yarn is draw-textured by a draw ratio such as to provide a bulky yarn of tenacity-at-break-denier $(T_B)_n$ of at least 4 g/dd, where $(T_B)_n$=Tenacity(g/d)$(RDR)_S$ $(20.8/LRV)^{0.75}$, where $(RDR)_S$ is the residual spun draw ratio and is defined by $(RDR)_S=[1+(E_B)/100]$, where $(E_B)$ is the percentage elongation-to-break; an elongation-to-break $(E_B)$ of 20 to 45%; and a Fray Count of less than 10 frays per 1000 meters.

10. A process according to claim 9, wherein a low-friction device is provided to reduce twist-induced draw in the draw-texturing threadline between the first upstream contact point and the first friction twist insertion point such as to provide a "break angle" of less than 15 degrees and to increase radius of curvature of the upstream contact to greater than 2.5 mm.

11. A process according to any one of claims 1 to 3, wherein filaments of different deniers or cross-sections are co-spun from the same extrusion spinneret.

* * * * *